US008468836B2

(12) United States Patent
Tuszkiewicz et al.

(10) Patent No.: US 8,468,836 B2
(45) Date of Patent: Jun. 25, 2013

(54) PORTABLE THERMOELECTRIC COOLING/HEATING UNIT AND RELATED MERCHANDIZING SYSTEM

(75) Inventors: George A. Tuszkiewicz, Plymouth, MN (US); Mark Bedard, Greenfield Park, CA (US)

(73) Assignee: General Mills, Inc., Minneapolis, MN (US)

( * ) Notice: Subject to any disclaimer, the term of this patent is extended or adjusted under 35 U.S.C. 154(b) by 1107 days.

(21) Appl. No.: 12/269,622

(22) Filed: Nov. 12, 2008

(65) Prior Publication Data

US 2010/0115969 A1 May 13, 2010

(51) Int. Cl.

| | |
|---|---|
| ***F25B 21/02*** | (2006.01) |
| ***F25D 21/00*** | (2006.01) |
| ***F25D 21/14*** | (2006.01) |

(52) U.S. Cl.

USPC ..... 62/3.3; 62/285; 62/272

(58) Field of Classification Search

USPC ..... 62/3.3, 3.6, 285, 272, 286, 288, 289, 62/291, 3.4

See application file for complete search history.

(56) References Cited

U.S. PATENT DOCUMENTS

| | | | | |
|---|---|---|---|---|
| 2,837,899 | A | 6/1958 | Lindenblad | |
| 3,177,670 | A | 4/1965 | Boehmer et al. | |
| 3,283,520 | A | 11/1966 | Donohue et al. | |
| 3,315,474 | A | 4/1967 | Farer | |
| 3,399,546 | A | 9/1968 | Kuns et al. | |
| 3,733,836 | A | 5/1973 | Corini | |
| 4,007,600 | A | 2/1977 | Simms | |
| 4,326,383 | A | 4/1982 | Reed et al. | |
| 4,537,034 | A | 8/1985 | Crouch | |
| 4,726,193 | A | 2/1988 | Burke et al. | |
| D299,391 | S | 1/1989 | Meehan | |
| 4,882,910 | A | 11/1989 | Meehan et al. | |
| D307,026 | S | 4/1990 | Barish | |
| 4,946,032 | A | 8/1990 | Stoddard et al. | |
| 5,301,508 | A * | 4/1994 | Kahl et al. | 62/3.62 |

(Continued)

FOREIGN PATENT DOCUMENTS

| | | |
|---|---|---|
| CA | 2 462 635 A1 | 9/2005 |
| EP | 0 572 264 B1 | 7/1996 |

(Continued)

OTHER PUBLICATIONS

PCT Search Report (mailed Jan. 6, 2010); 10 pgs.

(Continued)

*Primary Examiner* — Judy Swann
*Assistant Examiner* — Ignacio E Landeros
(74) *Attorney, Agent, or Firm* — Timothy A. Czaja; Annette M. Frawley

(57) ABSTRACT

A portable cooling/heating unit for cooling/heating a product container. The unit includes a thermoelectric assembly, a housing, a front side fan, and a rear side fan. The thermoelectric assembly includes a thermoelectric device, a first heat sink, and a second heat sink. The housing maintains the first heat sink and front fan within a front side channel, and the second heat sink and rear fan within a rear side channel. The housing further forms a condensation passageway segment that facilitates fluid connection between the channels. During use, the unit is removably assembled to the container such that openings of the front side channel are fluidly within the container's interior region. Accumulated condensation is directed to the rear side channel and evaporated.

23 Claims, 20 Drawing Sheets

U.S. PATENT DOCUMENTS

| | | | | |
|---|---|---|---|---|
| 5,315,830 | A * | 5/1994 | Doke et al. | 62/3.2 |
| 5,357,767 | A | 10/1994 | Roberts | |
| 5,367,879 | A | 11/1994 | Doke et al. | |
| 5,481,886 | A * | 1/1996 | Hasegawa et al. | 62/285 |
| 5,501,076 | A | 3/1996 | Sharp, III et al. | |
| 5,522,216 | A * | 6/1996 | Park et al. | 62/3.6 |
| 5,561,981 | A | 10/1996 | Quisenberry et al. | |
| 5,607,047 | A | 3/1997 | Leet et al. | |
| 5,718,124 | A | 2/1998 | Senecal | |
| D396,048 | S | 7/1998 | Meehan | |
| 5,782,094 | A | 7/1998 | Freeman | |
| 5,927,078 | A | 7/1999 | Watanabe et al. | |
| 6,003,318 | A | 12/1999 | Busick et al. | |
| 6,003,319 | A | 12/1999 | Gilley et al. | |
| 6,205,790 | B1 | 3/2001 | Denkin et al. | |
| 6,298,673 | B1 | 10/2001 | Fung et al. | |
| 6,351,964 | B1 | 3/2002 | Brancheau et al. | |
| 6,401,399 | B1 | 6/2002 | Roche et al. | |
| 6,460,372 | B1 | 10/2002 | Fung et al. | |
| 6,463,743 | B1 | 10/2002 | Laliberte | |
| 6,550,255 | B2 | 4/2003 | Rudick et al. | |
| 6,658,858 | B1 | 12/2003 | Thompson et al. | |
| 6,701,736 | B1 | 3/2004 | Johnson | |
| 6,976,371 | B2 | 12/2005 | Gleason et al. | |
| 7,107,779 | B2 | 9/2006 | Avenwedde et al. | |
| 7,152,412 | B2 | 12/2006 | Harvie | |
| 7,430,877 | B2 * | 10/2008 | Davenport et al. | 62/285 |
| 7,451,603 | B2 | 11/2008 | Tuszkiewicz et al. | |
| 2001/0042383 | A1 | 11/2001 | Chiang et al. | |
| 2001/0042384 | A1 | 11/2001 | Chiang et al. | |
| 2002/0121096 | A1 | 9/2002 | Harrison et al. | |
| 2003/0115902 | A1 | 6/2003 | Busick et al. | |
| 2004/0194496 | A1 | 10/2004 | Gleason et al. | |
| 2005/0210884 | A1 * | 9/2005 | Tuskiewicz et al. | 62/3.6 |
| 2006/0288709 | A1 * | 12/2006 | Reidy | 62/3.4 |
| 2007/0119186 | A1 * | 5/2007 | Kitchens et al. | 62/3.3 |

FOREIGN PATENT DOCUMENTS

| | | | |
|---|---|---|---|
| GB | 2 252 815 | A | 8/1992 |
| JP | 2002-22345 | A | 1/2002 |
| SU | 1195152 | A1 | 11/1985 |
| WO | 97/39296 | | 10/1997 |
| WO | 03/099703 | A2 | 12/2003 |
| WO | 2006/122428 | A1 | 11/2006 |

OTHER PUBLICATIONS

S. Godfrey "Electronics Cooling—An Introduction to Thermoelectric Coolers", available a http://www.electronics-cooling.com/Resources/EC_Articies/SEPT96/sep96_4.htm; 6 pgs; Sep. 1996.

* cited by examiner

PORTABLE THERMOELECTRIC COOLING/HEATING UNIT AND RELATED MERCHANDIZING SYSTEM

BACKGROUND

The present disclosure relates to temperature controlled merchandizing units. More particularly, it relates to a portable, cooled and/or heated merchandizing unit incorporating thermoelectric devices.

Grocers and other retail sellers of packaged, consumable items often desire the ability to present such products to potential consumers in a heated or cooled form. In fact, with perishable products, maintaining the items in a cooled environment can be a necessity.

Conventionally, large refrigeration/freezer units are employed at the point of sale to maintain and display cooled/frozen products to consumers. Convection-type or radiant-type ovens are also common for presenting warmed products. While viable, these and other temperature control appliances are essentially immovable once installed, expensive to manufacture/operate, or both. For example, a compressed Freon refrigeration unit can maintain a large number of products at a desired temperature; however, the refrigeration unit is not easily moved to different, desired locations within a retailer's place of business. With many product promotions, short-term presentation of cooled/heated products at different or more prominent store locations is desired; unfortunately, typical in-store refrigerators or ovens do not provide the flexibility required by such promotions.

More recently, cooling systems have been suggested that utilize thermoelectric devices. Thermoelectric devices operate on a direct current (DC) voltage system, can be employed to maintain a desired temperature in refrigerators and portable coolers, and provide various advantages over vapor pressure-type refrigerators. One example of a cooled container employing a thermoelectric device is described in U.S. Pat. No. 4,726,193 entitled "Temperature Controlled Picnic Box." The temperature controlled picnic box is described as having a housing with insulated walls forming a food compartment, an open top, and a lid for enclosing the food compartment. A thermoelectric device for cooling the picnic box is connected to the lid by fasteners. The thermoelectric device is limited in its capacity to cool the picnic box, and the enclosed food compartment is ill-suited for temporary retail store cooling displays.

While thermoelectric cooling appears promising for merchandizing applications, other factors associated with large scale production of such devices remains unaddressed. Different retail sellers will desire product containers of differing sizes and/or shapes (e.g., ranging from large, coffin-style freezers to small, shelf-sized units). It is economically impractical for a manufacturer to make and hold in inventory thermoelectric merchandizing units in accordance with each and every possible size/shape desired by multiple end users. Similarly, manufacturers cannot, on a cost-effective basis, readily design and create a newly-styled thermoelectric merchandizing unit from scratch in response to every unique customer request, especially where certification of the electrical components (e.g., UL certification) is needed. Further, certain retailers require cooling-type applications, others require heating-type applications, and yet others desire both. Existing, thermoelectric-based devices do not appear to contemplate meeting all such applications with a single design.

In light of the above, a need exists for a portable, temperature controlled merchandizing unit capable of satisfying the needs of diverse end users.

SUMMARY

Some aspects in accordance with principles of the present disclosure relate to a portable cooling/heating unit for removable mounting to a product container for cooling/heating an interior containment region of the product container. The cooling/heating unit includes a housing, a thermoelectric assembly, a front side fan, and a rear side fan. The housing includes a front panel and a rear panel that are assembled to a base. Further, the housing forms a front side channel, a rear side channel, and a condensation passageway segment. The front side channel is at least partially defined by the front panel, whereas the rear side channel is at least partially defined by the rear panel. Further, the condensation passageway segment is at least partially defined by the base and fluidly connects the front and rear side channels via a condensation passageway that otherwise includes the condensation passageway segment. The thermoelectric assembly is maintained by the housing and includes a thermoelectric device, a first heat sink, and a second heat sink. The first heat sink is thermally connected to a first surface of the thermoelectric device, and is maintained within the front side channel. The second heat sink is thermally connected to an opposing, second surface of the thermoelectric device, and is maintained within the rear side channel. Finally, the front side fan is disposed within the front side channel, whereas the rear side fan is disposed within the rear side channel. With this construction, the cooling/heating unit is configured for removable assembly to a product container such that the front side channel is fluidly open to an interior containment region of the product container. Further, condensation generated at the first heat sink during operation of the thermoelectric device is directed from the front side channel to the rear side channel via the condensation passageway. Thus, the cooling/heating unit of the present disclosure is useful as a modular component assembleable to a variety of different product container designs, and provides appropriate condensation management heretofore unavailable with other modular thermoelectric configurations. In some embodiments, the cooling/heating unit further includes a power supply unit and controller that are carried within the housing and effectuate necessary provision of DC power to the thermoelectric device in a metered fashion.

Other aspects in accordance with principles of the present disclosure relate to a portable, temperature controlled merchandising system including a product container and a cooling/heating unit. The product container forms an interior containment region for containing product that is exteriorly accessible via an access opening. The cooling/heating unit is configured as described above, and is removably assembled to the product container via mounting of the housing to the access opening. When mounted, the front side channel of the cooling/heating unit is fluidly open to the interior containment region. In some embodiments, the product container includes an interior compartment formed within an outer casing, with the compartment having one or more liner walls that are connected to the cooling/heating unit in a fluidly sealed-type manner upon final assembly.

Yet other aspects in accordance with principles of the present disclosure relate to methods for presenting products to potential consumers. The method includes providing the cooling/heating unit as described above, as well as forming a product container defining an interior containment region that is exteriorly accessible via an access opening. The cooling/heating unit is removably mounted to the product container by inserting the front panel into the access opening. Product is then loaded into the interior containment region, and the cooling/heating unit operated to alter a temperature of the so-loaded product. In this regard, condensation generated by operation of the thermoelectric device along the front side channel is directed through the condensation passageway and evaporated to an exterior of the cooling/heating unit via the rear side channel. In some embodiments, the product container is formed apart from the cooling/heating unit, and incorporates a unique size and/or shape as desired by a user.

DETAILED DESCRIPTION

Figure 1:
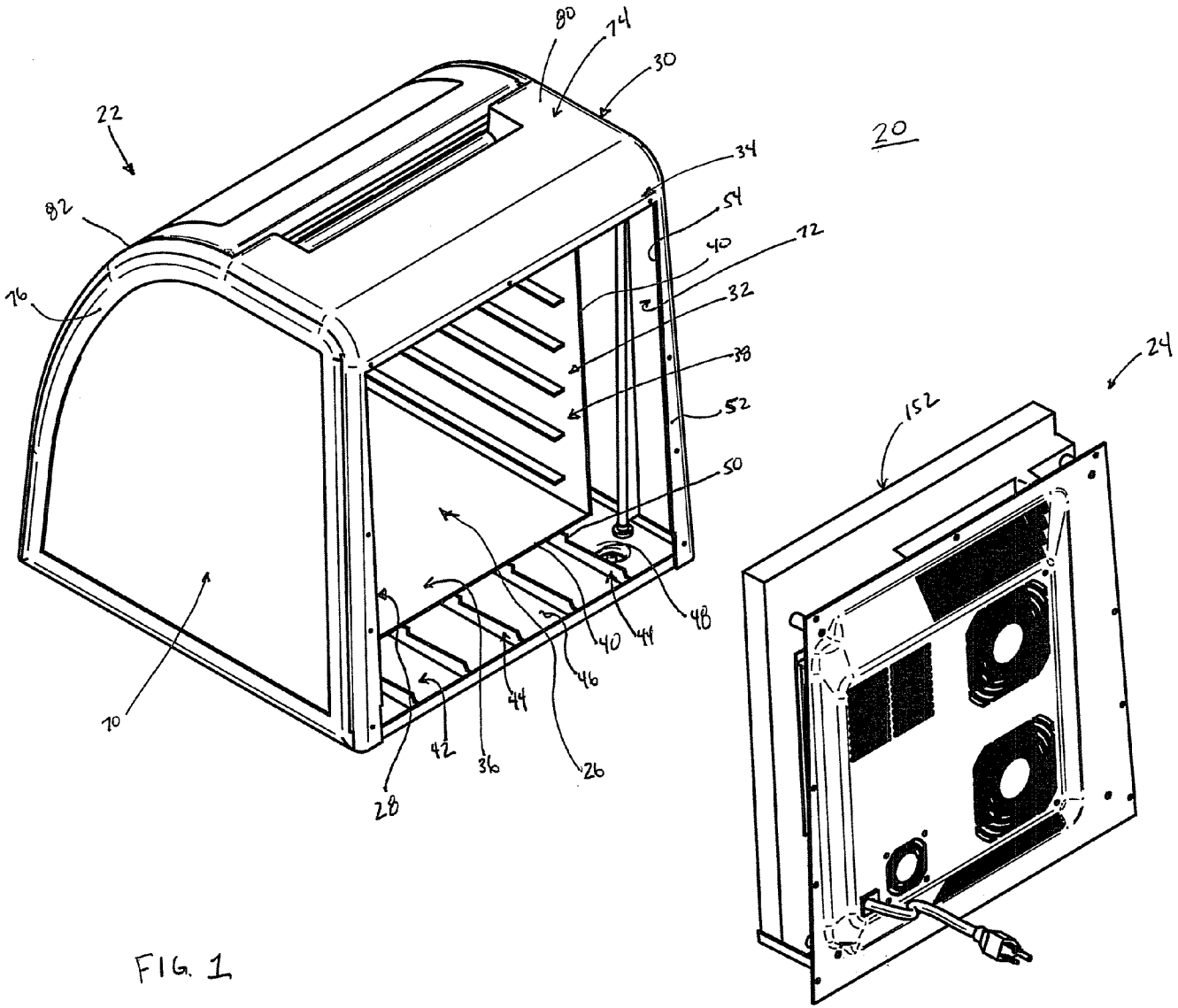
FIG. 1 is an exploded, perspective view of a temperature controlled merchandizing system in accordance with principles of the present disclosure.

One embodiment of a portable, temperature controlled merchandizing system 20 in accordance with aspects of the present disclosure is shown in FIG. 1. The system 20 generally includes a product container 22 and a cooling/heating unit 24. Details on the various components are provided below. In general terms, however, the cooling/heating unit 24 is removably assembled to the product container 22, and incorporates thermoelectric technology operable to alter a temperature of an interior containment region 26 of the product container 22, and thus product (not shown) contained therein. In this regard, the cooling/heating unit 24 is highly compact, and is readily implemented with a plethora of differently sized and/or shaped versions of the product container 22. Further, in some embodiments, the cooling/heating unit 24 permits a user to dictate whether the interior containment region 26 is subjected to heating or cooling, and incorporates internal condensation management features.

As alluded to above, the product container 22 can have a wide variety of different sizes/dimensions and/or shapes appropriate for a particular in-store merchandizing application; thus, the but one exemplary configuration of FIG. 1 is in no way limiting. The product container 22 can be sized as an upright countertop-type cooler, an in-shelving cooler, a coffin-style cooler, etc. In more general terms, then, the product container 22 rear wall 34 forms an access opening 28 to the interior containment region 26. Mounting of the cooling/heating unit 24 to the product container 22, and in particular to the interior containment region 26, is achieved via the access opening 28.

The product container 22 can include an outer casing 30 and an interior compartment 32. The access opening 28 is defined by the outer casing 30, and in particular a rear wall 34 provided therewith. The separate compartment 32 is formed or mounted within the outer casing 30, and defines the interior containment region 26. In other embodiments, the outer casing 30 alone forms the interior containment region 26, such that the separately-defined compartment 32 is optional. Where provided, the compartment 32 can include a platform 36, opposing side liners or walls 38 (one of which is visible in FIG. 1), and a top liner or wall (hidden in the view of FIG. 1). The compartment 32 components terminate at a common leading end 40 arranged adjacent the access opening 28 and configured to be received by a corresponding component of the cooling/heating unit 24 as described below. With this but one acceptable construction, the outer casing 30 surrounds the compartment 32 and forms walls that are exteriorly spaced from the compartment 32. For example, the outer casing 30 includes a bottom wall 42 spaced below (relative to the orientation of FIG. 1) the platform 36. The bottom wall 42 can have various shapes and/or sizes as desired by an end user, and in some configurations includes or forms one or more upwardly projecting shoulders 44. The shoulders 44 are formed adjacent the rear wall 34, and are each defined as an upward projection from a major planar face 46 of the bottom wall 42. The shoulder(s) are located between the end 40 of the platform 36 and the rear wall 34. As described below, each of the shoulders 44 provides a support surface 48 and a stop surface 50 that are spatially located to support the cooling/heating unit 24 at a known location relative to the rear wall 34 of the product container 22. While FIG. 1 illustrates a plurality of shoulders 44, in other embodiments a single, elongated shoulder can be provided. Even further, the shoulders 44 can be entirely omitted.

The rear wall 34 forms a trailing surface 52 through which the access opening 28 is defined. A lip 54 circumscribes the access opening 28, and facilitates insertion of the cooling/heating unit 24. In this regard, the lip 54 includes a lower segment 56 that is spatially aligned with the support surface 48 of the shoulders 44 for reasons made clear below.

While a size and shape of the access opening 28 and the collective leading end 40 of the optional compartment 32 are predetermined as a function of a size and shape of the cooling/heating unit 24, other dimensional and/or shape features of the outer casing 30 can be varied. For example, the product container 22 can include opposing side walls 70, 72 and a leading wall 74. The side walls 70, 72 have identical shapes and dimensions, and extend from the bottom wall 42 and the rear wall 34. Further, a leading edge 76 (identified for the side wall 70 in FIG. 1) has an arcuate segment, corresponding with a shape of the leading wall 74. Regardless, the side walls 70, 72 can permanently display indicia (e.g., advertising) and/or can be adapted to removably receive correspondingly-shaped signage, for example via open-ended slots.

With the one acceptable example of FIG. 1, the leading wall 74 forms a top portion 80 and a front portion 82. The top portion 80 defines an upper-most surface of the product container 22, with the front portion 82 extending from the top portion 80 to the bottom wall 42 in a curved fashion.

Figure 2:
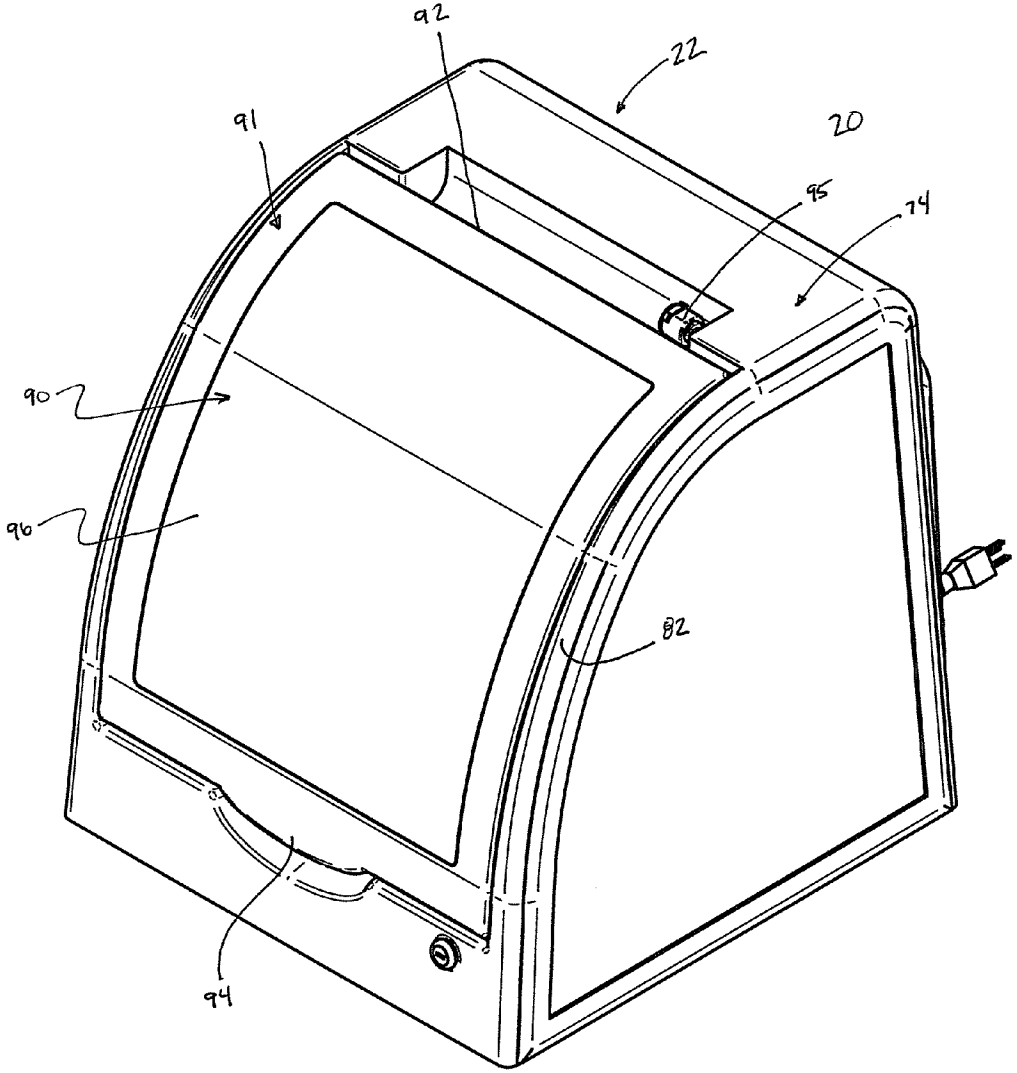
FIG. 2 is a front, perspective view of a product container portion of the system of FIG. 1.

As best shown in FIG. 2, the leading wall 74 is configured to pivotably maintain a door 90. The door 90 is shaped in accordance with a shape of the front portion 82 (and vice-versa), and includes a frame 91 defining a hinged end 92 and a handle end 94. The hinged end 92 is pivotably coupled to the leading wall 74, with the handle end 94 facilitating opening of the door 90 (and thus access to the interior containment region 26 (FIG. 1)) by a consumer. An optional closure mechanism 95 can be provided that allows the door 90 to be easily opened by a consumer, but resists rapid, gravity-induced self-closing of the door 90.

Figure 3A:
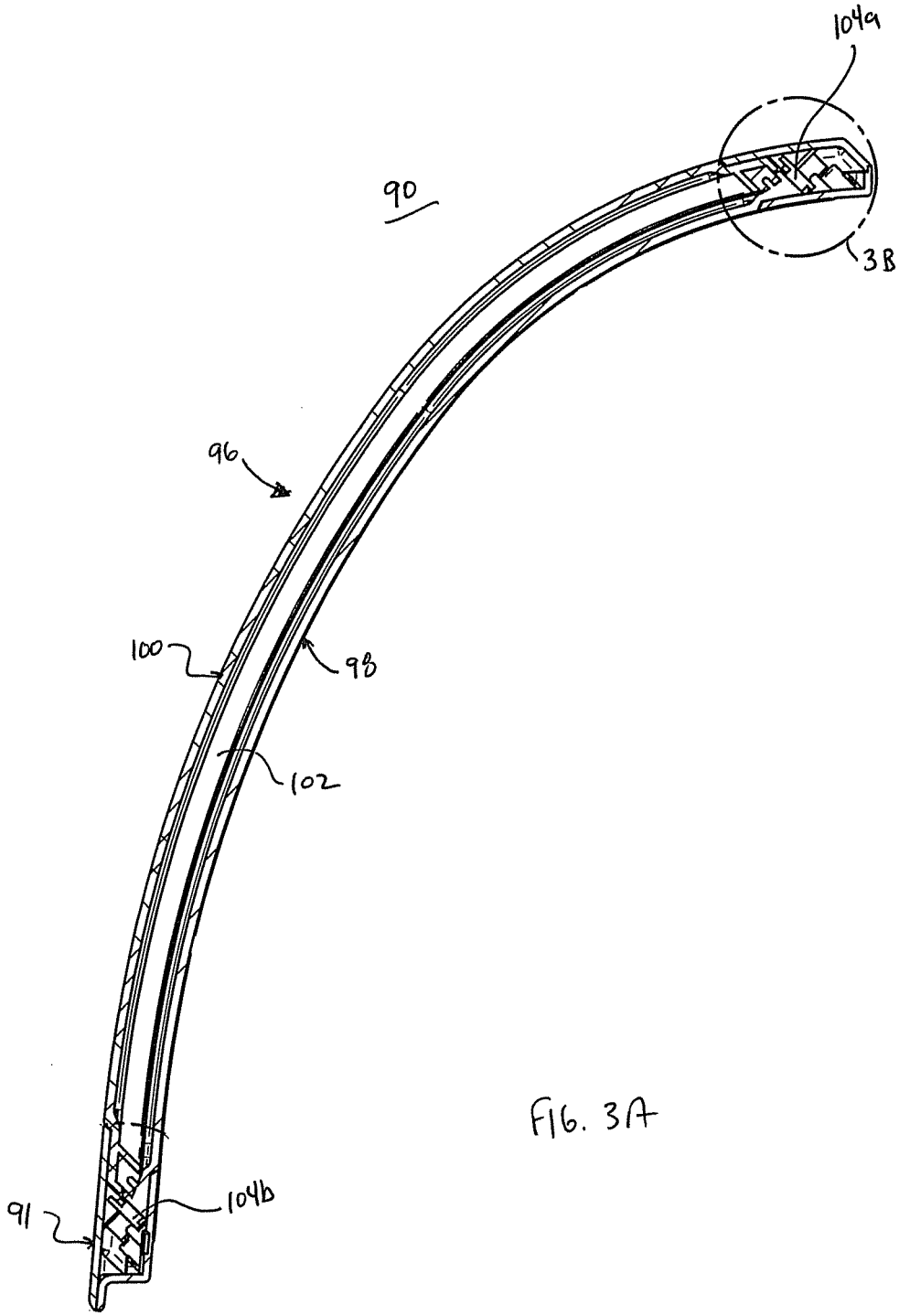
FIG. 3A is a cross-sectional view of a door useful with a product container portion of the system of FIG. 1.

In some embodiments, the door 90 includes a window assembly 96 mounted to the frame 91. FIG. 3A illustrates the window assembly 96 as including an interior pane 98 and an exterior pane 100 that are both curved and maintained in a spaced relationship by the frame 91. As a point of reference, conventional cooler doors/windows are typically formed as planar, transparent thermal panels. With the window assembly 96, however, the transparent panes 98, 100 are curved, and define an insulating air space 102 therebetween to minimize condensation. In related embodiments, the panes 98, 100 are formed of acrylic or similar materials; alternatively, other relatively clear thermoplastic materials such as polycarbonate-based materials (e.g., Lexan®) can be employed. The curved shape of the window assembly 96 is visually pleasing, and allows a potential consumer to view contents of the product container 22 (FIG. 2) from a multiplicity of locations.

Figure 3B:
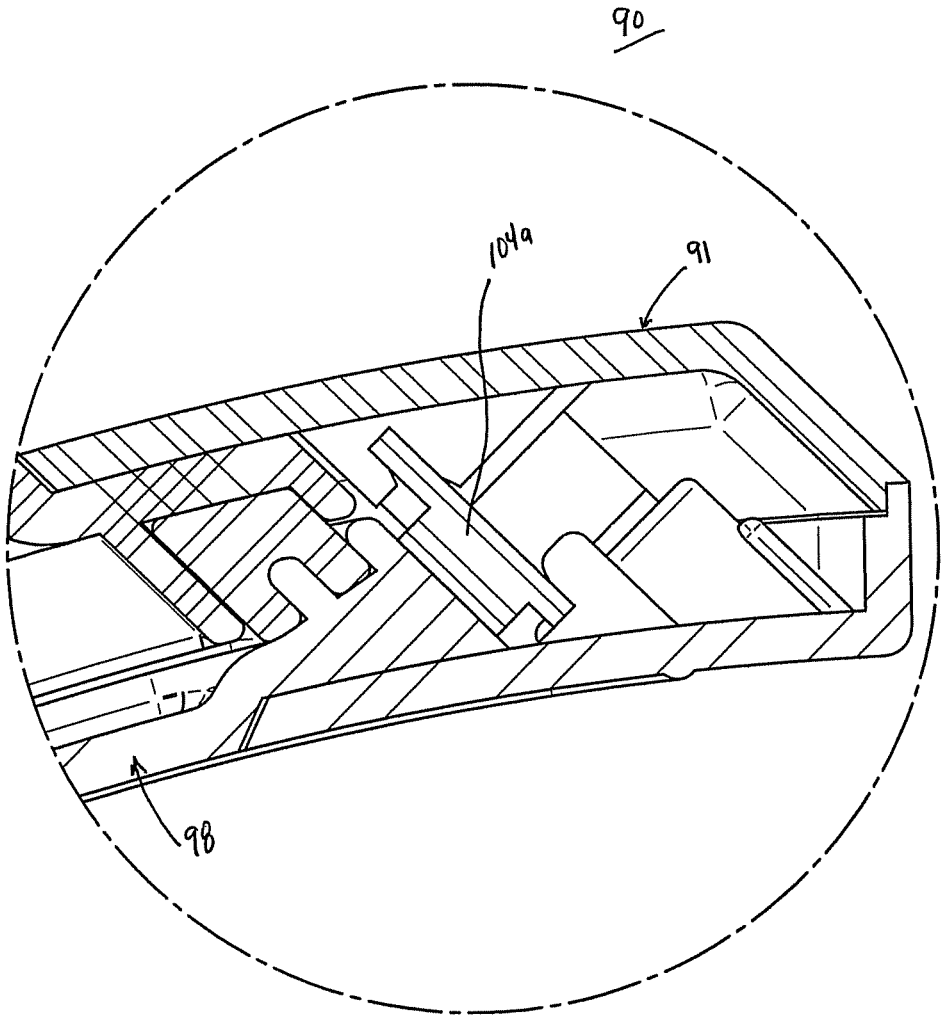
FIG. 3B is an enlarged view of a portion of the door of FIG. 2A.

Optional light sources (e.g., LEDs) 104*a*, 104*b* can be provided with the door 90, and located to direct light at the curved interior pane 98. The light sources 104*a*, 104*b* can be powered by the heating/cooling unit 24 (FIG. 1) as described below, and thus the door 90 can include light source wires (not shown) extending through the frame 91 and from the hinged end 92 for power connection to the cooling/heating unit 24. Alternatively, a separate power source (e.g., a battery) can be included with product container 22. Regardless, FIG. 3B illustrates an orientation of the light source 104*a* relative to the interior pane 98. Where the light source 104*a* is an LED point light source (or plurality of LEDs), the light source 104*a* is positioned to focus light into and along a plane or curvature of the interior panel 98. The curved nature of the interior pane 98 allows the so-directed light to illuminate the interior containment region 26 (FIG. 1). In related embodiments, the interior pane 98 is etched and/or surface treated with a desired display (e.g., logo); light emitted along a plane of the window assembly 96 is dispersed at the etching/surface treatment and provides a visually interesting display to potential consumers. In other embodiments, however, the door 90 and/or window assembly 96 can assume a more conventional format.

Returning to FIG. 1, the cooling/heating unit 24 is formed as a structural component apart from the product container 22. Thus, the cooling/heating unit 24 is mountable to, and removable from, the product container 22. With this in mind, one configuration of the cooling/heating unit 24 is shown in greater detail in FIG. 4, and includes a thermoelectric assembly 110, a power supply unit 112, a controller 114, a housing 116 (referenced generally), one or more front side fans 118, and one or more rear side fans 120. An optional user display 122 can also be provided, as well as a power supply circuitry cooling fan 124. Regardless, the housing 116 maintains the components 110-114 and 118-124, and establishes channels for distributing airflow relative to the thermoelectric assembly 110 in a desired manner.

The thermoelectric assembly 110 includes a thermoelectric device 130, a first heat sink 132, and a second heat sink 134. As described in greater detail below, the thermoelectric device 130 operates, to heat or cool the heat sinks 132, 134 in an opposing manner (e.g., the first heat sink 132 is cooled while the second heat sink 134 is heated). The front side fan(s) 118 (as prompted by the controller 114) directs airflow over the first heat sink 132, whereas the rear side fan(s) 120 directs airflow over the second heat sink 134.

The thermoelectric device 130 is a Peltier effect-type device, having one or more flat, board-like semiconductor devices. A direct electrical current is applied to the semiconductor device(s) that results in a corresponding transfer of heat from one side of the semiconductor device to the other, thereby creating a cold side and a hot side. For example, in one embodiment, the thermoelectric device 130 includes two opposing ceramic wafers (not shown) having a series of P- and N-doped bismuth-telluride semiconductors layered between the ceramic wafers. The P-type semiconductor has a deficit of electrons and the N-type semiconductor has an excess of electrons. When the DC power is applied to the thermoelectric device 130, a temperature difference is created across the P- and the N-type semiconductors, and electrons move from the P-type to the N-type semiconductor. In this manner, the electrons move to a higher energy state, as known in the art, thus absorbing thermal energy and forming a cold region at one side of the thermoelectric device 130. The electrons at the N-type semiconductor continue through the series of semiconductors to arrive at the P-type semiconductor, where the electrons drop to a lower energy state and release energy as heat to a hot region at an opposite side of the thermoelectric device 130. The above-described flow of electrons driven through P- and N-type semiconductors by DC power is known in the art as the Peltier effect. Peltier effect thermoelectric devices can be beneficially employed as cooling devices or operated in reverse to create a heating device. In any regard, suitable thermoelectric devices for implementing embodiments of the present disclosure are known and commercially available.

The first heat sink 132 is thermally connected (e.g., directly coupled) to the first side of the thermoelectric device 130, whereas the second heat sink 134 is thermally connected to the opposite side. The heat sinks 132, 134 are made of an appropriate material, such as aluminum or copper, although other known heat sink materials are also acceptable. In some constructions, the first heat sink 132 has a smaller footprint as compared to the second heat sink 134 for reasons made clear below. Alternatively, the first heat sink 132 can be larger than, or identical to, the second heat sink 134.

In some constructions, the cooling/heating unit 24 is configured to operate solely upon powering by a conventional AC power source (e.g., a wall socket providing 115 V or 230 V AC power). The power supply unit 112 is included to convert the incoming AC power to DC power required by the thermoelectric device 130. With this in mind, the power supply unit 112 is electrically connected to a power cord 138 that supplies alternating current (AC) power from a conventional wall source to the power supply unit 112. The power supply unit 112 incorporates known switching power supply electrical components capable of converting the AC power to direct current (DC) power (e.g., 21.5 volt or 24 volt DC). The so-applied current is formatted to achieve heating or cooling of the desired side (and thus the corresponding heat sink) of the thermoelectric device 130. More particularly, the controller 114 is electrically disposed between the power supply unit 112 and the thermoelectric device 130, and is programmed to control delivery of power, at the power supply unit 112, to the thermoelectric device 130. In other words, the controller 114 receives DC power from the power supply 112 and meters delivery of power to the thermoelectric device 130. The controller 114 can thus assume a variety of forms (e.g., electrical circuitry, processor, etc.), and includes a control board or panel that optionally facilitates modification or selection of various settings by a user.

In one embodiment, the controller 114 is adapted to meter the delivery of DC power to the thermoelectric device 130 such that the thermoelectric device 130 has a sufficient flow of DC power even in low-use (i.e., "sleep" modes). The controller 114 regulates DC power flow to the thermoelectric device 130 to optimally power the device 130 during high peak usage, and the controller 114 also ensures that some DC power is delivered to the thermoelectric device 130 during low use, or sleep periods such that the thermoelectric device 130 is maintained in a "on" state.

In one embodiment, the controller 114 utilizes a pulse width modulation control sequence to achieve optimal temperature control. In particular, the controller 114 is connected to one or more temperature sensors (not shown) otherwise located to sense temperatures at or near the interior containment region 26 (FIG. 1). As the sensed temperature is approaching a desired temperature, the controller 114 modulates power delivered to the thermoelectric device 130 by pulsing the delivered power in a linear fashion to decrease the temperature changing effect caused by the thermoelectric device 130. Conversely, where a greater impact on temperature is determined to be necessary, the controller 114 operates to provide a more steady power supply (i.e., decrease in the frequency of pulsed off power), thereby providing more power to the thermoelectric device 130.

As indicated above, the controller 114 is operable to dictate heating or cooling of either side of the thermoelectric device 130 (i.e., the first heat sink 132 can be heated or cooled by the thermoelectric device 130 as dictated by operation of the controller 114). In this regard, the heating/cooling unit 24 can be configured such that the controller 114 powers the thermoelectric device 130 in a singular manner (i.e., the first heat sink 132 is always heated or always cooled). Alternatively, the controller 114 can be configured to allow a user to select whether the cooling/heating unit 24 operates in a heating mode or a cooling mode. As a point of clarification, the "mode" of the cooling/heating unit 24 is in reference to the temperature at the first heat sink 132, as airflow to/from the product container 22 is directed across the first heat sink 132. Thus, for example, in instances where the thermoelectric device 130 operates to cool the first heat sink 132 (and thus heat the second heat sink 134), the cooling/heating unit 24 is considered to be operating in a cooling mode. Even further, the controller 114 can permit additional user control over operation of the controller 114 such as, for example, establishing user-selected desired temperatures or temperature ranges, time periods of operation, etc.

The housing 116 includes, in some constructions, an interior partition assembly 150, a front panel 152, a rear panel 154, and a base 156. The interior partition assembly 150 maintains the thermoelectric device 130 and the heat sinks 132, 134 relative to the front and rear panels 152, 154, and establishes portions of airflow channels along the heat sinks 132, 134. The base 156 is mounted to at least the interior partition assembly 150 and the front panel 152, and establishes a condensation passageway between the flow channels as described below.

The interior partition assembly 150 includes, in some embodiments, a support panel 160 and an isolation panel 162. The support panel 160 is mounted to the isolation panel 162, and includes a planar member 164 and opposing columns 166*a*, 166*b*. The planar member 164 defines a leading face 168, a trailing face 170 (referenced generally), and an aperture 172 through a thickness thereof. The aperture 172 is sized and shaped in accordance with a size and shape of the first heat sink 132 and optionally the thermoelectric device 130. Upon final construction of the thermoelectric assembly 110 to the support panel 160, then, at least the first heat sink 132, and optionally the thermoelectric device 130, is received within, and projects through, the aperture 172. The second heat sink 134 is dimensionally larger than the aperture 172 and thus is located adjacent (optionally abutting) the trailing face 170.

The columns 166*a*, 166*b* project from the trailing face 170, extending along opposite sides of the aperture 172, respectively. A lateral spacing between the columns 166*a*, 166*b* is greater than a width of the second heat sink 134. The columns 166*a*, 166*b* can be identical, and serve to fluidly isolate the opposing edges of the second heat sink 134 upon final assembly and as described below. In some embodiments, an additional rib (not shown) projects from the trailing face 170 generally perpendicular to the columns 166*a*, 166*b* at a location spaced from a top edge 173 of the aperture 172. Where provided, the rib encompasses and fluidly isolates an upper end of the second heat sink 134 upon final assembly.

In some embodiments, the support panel 160 further includes posts 174 extending from the trailing face 170 at corners of the planar member 164. The posts 174 facilitate mounting to the rear panel 154 as described below. Alternatively, other mounting techniques can be employed such that the posts 174 can be replaced with other components, or eliminated.

A flange 176 is optionally provided as a forward projection from the leading face 168 and promotes a more robust assembly of the support panel 160 to the isolation panel 162. The flange 176 can be formed along an entire perimeter of the planar member 164 or can include only a lower segment or leg 178. As described below, the leg 178 forms part of a condensation management feature incorporated into the cooling/heating unit 24. Alternatively, the flange 170 can be eliminated.

The isolation panel 162 includes a planar face 180 defining a top edge 182, a bottom edge 184, and opposing side edges 186, 188. A cavity 190 is formed in the planar face 180, and is defined by opposing, first and second end sections 192, 194, and an intermediate section 196. The first end section 192 is formed adjacent to, but spaced from, the top edge 182, and is generally sized in accordance with the front side fan(s) 118. The first section 192 is closed opposite the planar face 180 via a back wall 198. An upper wall 200 and opposing side walls 202 (one of which is visible in the view of FIG. 4) further circumscribe the first end section 192, with the side walls 202 defining a width thereof.

The intermediate section 196 extends from the first end section 192, and is shaped and sized in accordance with the shape and size of the first heat sink 132. In this regard, the intermediate section 196 is fluidly open through a thickness of the isolation panel 162, such that the first heat sink 132 can be inserted into the intermediate section 196. To provide enhanced airflow interface with the first heat sink 132, a width of the intermediate section 196 can be commensurate with a width of the first heat sink 132, and in some constructions is less than a width of the first end section 192.

Finally, the second end section 194 extends from the intermediate section 196 opposite the first end section 192, and is fluidly closed opposite the planar face 180 by a back wall 204. In contrast to the first end section 192, however, the second end section 194 is fluidly open at the bottom edge 184. Further, a width of the second end section 194 can be greater than the widths of the first end section 192 and the intermediate section 190 in some embodiments.

The cavity 190 can be sized and shaped to facilitate desired airflow attributes. For example, and as described in greater detail below, upon final assembly, the front side fans 118 are positioned to direct airflow into the first end section 192. While the first end section 192 is sized to direct airflow to the intermediate section 196 in a relatively free manner via the walls 200-202, a size and shape of the first end section 192 is relatively smaller those of the front side fan(s) 118 such that a velocity of airflow entering the first end section 192 is relatively unaffected. Conversely, the second end section 194 is relatively large (as compared to a size or volume of the first end section 192), and distributes airflow across a majority of a width of the isolation panel 162. Alternatively, however, other configurations are equally acceptable. As reflected in FIG. 4, the isolation panel 162 can further form a slot 206 for maintaining the display 122 and/or related wiring. In other embodiments, however, the slot 206 can be eliminated.

The front panel 152 is configured for assembly to the isolation panel 162, and includes a planar body 210 defining a major plane of the front panel 152. In some constructions, a pocket 212 is formed as a forward projection from the planar body 210, and is sized to maintain the front side fan(s) 118. In this regard, the pocket 212 is positioned to maintain the front side fan(s) 118 in fluid communication with the first end portion 192 of the cavity 190 upon assembly to the isolation panel 162. Other configurations appropriate for maintaining the front side fan(s) 114 are also acceptable. Regardless, the front panel 152 forms one or more exterior inlet openings 214 that are fluidly open to the front side fan(s) 118 as described below.

In addition to the inlet openings 214, the front panel 152 forms one or more exterior outlet openings 216. The outlet openings 216 are fluidly open to the cavity 190, and in particular the second end section 194 upon final assembly of the front panel 152 to the isolation panel 162. In some constructions, the outlet openings 216 are oriented to direct airflow therethrough in a direction that is non-perpendicular relative to a plane of the planar body 210. For example, in some embodiments, the front panel 152 includes a shoulder segment 218 extending from the planar body 210 at an angle (relative to a plane defined by the planar body 210) of less than 180° (e.g., in the range of 100°-170°), and the outlet openings 216 are formed in the shoulder segment 218. With the angled relationship of the shoulder segment 218 relative to the planar body 210, forced airflow exiting the outlet openings 216 is directed in a non-perpendicular fashion relative to a plane of the planar body 210 (e.g., upwardly relative to a bottom of the front panel 152). Alternatively, other arrangements of the front panel 152 are also acceptable.

To facilitate sealed assembly to the product container 22 (FIG. 1), and in particular the compartment 32 (FIG. 1), the front panel 152 optionally forms one or more engagement members 220 as forward projections from the planar body 210. With the one construction of FIG. 4, an upper engagement member 220*a* and opposing side engagement members 220*b*, 220*c* are provided, although any other number and/or location is also acceptable. Regardless, the engagement members 220 each form a slot 222 (shown for the first side engagement member 220*b* in FIG. 4) sized to receive a corresponding surface of the compartment 32 (e.g., the leading end 40 (FIG. 1)) upon final assembly of the merchandizing system 20, and are thus arranged in accordance with a size and shape of the compartment 32. In other constructions, the engagement member(s) 220 can be eliminated.

Figure 4:
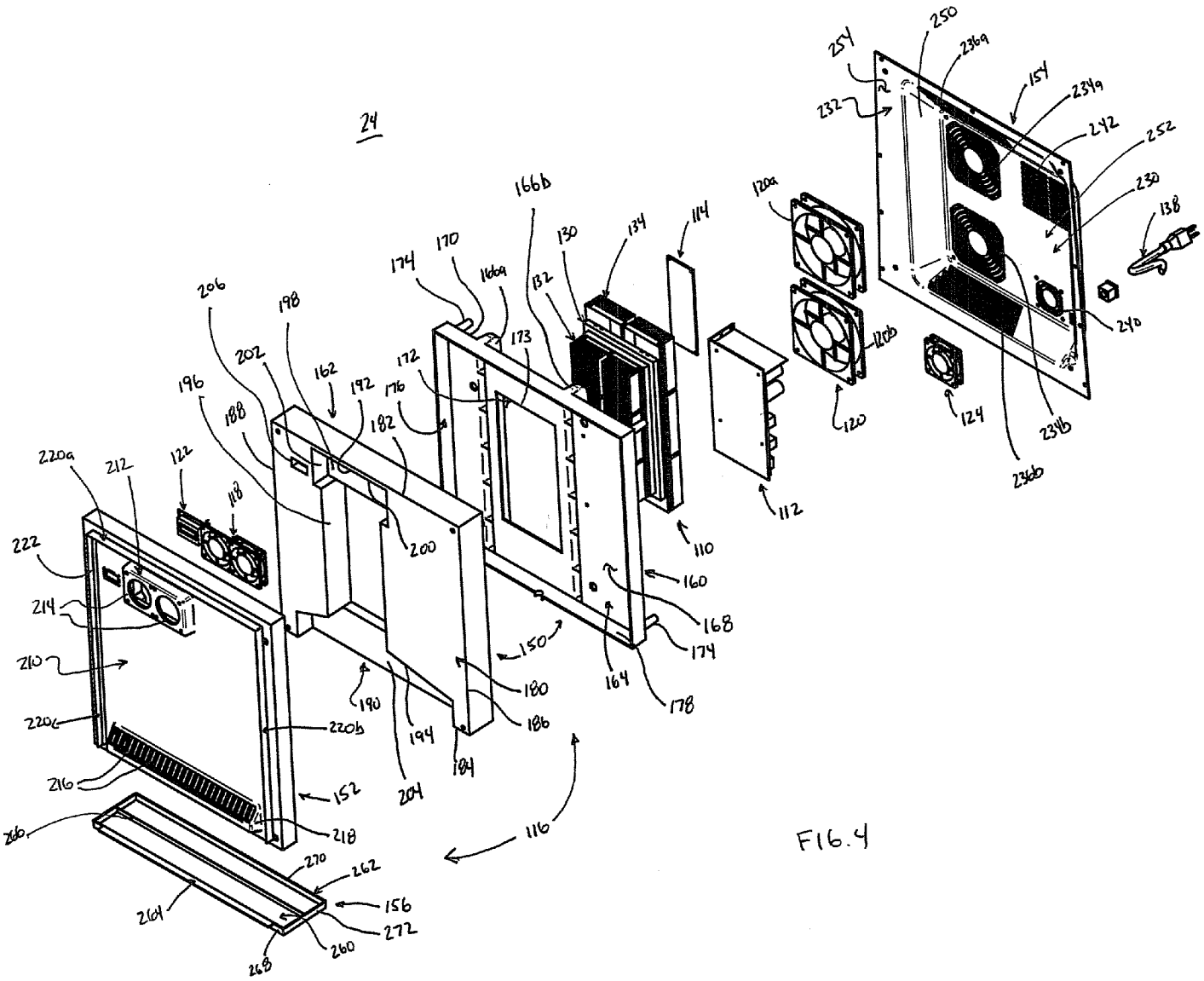
FIG. 4 is an exploded perspective view of a cooling/heating unit portion of the system of FIG. 1 in accordance with principles of the present disclosure.

The rear panel 154 includes a main body 230 and a flange 232. The main body 230 is adapted for mounting of the rear side fan(s) 120, and forms one or more exterior inlet openings 234 relative thereto. For example, with the but one acceptable configuration of FIG. 4, two of the rear side fans 120*a*, 120*b* are provided. With this in mind, the main body 230 forms a first set of inlet openings 234*a* that fluidly communication with the first rear side fan 120*a*, and a second set of inlet openings 234*b* that fluidly communication with the second rear side fan 120*b*. Similarly, the main body 230 forms one or more exterior outlet openings 236 in fluid communication with the rear side fan(s) 120. For example, as shown in FIG. 4, a first set of outlet openings 236*a* are formed and associated with the first rear side fan 120*a*, and a second set of outlet openings 236*b* are formed and associated with the second rear side fan 120*b*. The openings 234*a*-236*b* can assume a variety of forms differing from those reflected in FIG. 4 and are generally provided to facilitate ingress and egress of airflow through the rear panel 154.

Where provided, the rear panel 154 is further adapted to maintain the optional power supply circuitry cooling fan 124, and can form exterior inlet and outlet openings 240, 242 fluidly associated with the circuitry cooling fan 124 upon final assembly.

Regardless of the number and the arrangement of the exterior openings formed by the rear panel 154, the main body 230 forms an inwardly projecting perimeter portion 250 that terminates at the flange 232. With this construction, the rear panel 154 establishes a well 252 within which various components, such as the fans 120, 124 and the power supply unit 112, are maintained.

The flange 232 forms an interior surface 254 that facilitates assembly of the housing 116 to, as well as establishing an abutment face for sealed engagement with, the product container 22 (FIG. 1) as described below. In this regard, outer dimensions of the flange 232 are greater than the outer dimensions associated with the interior partition assembly 150 to facilitate robust mounting of the flange 232 to the product container 22.

The base 156 includes a bottom plate 260, a perimeter frame 262, a lip 264, and a rib 266. The perimeter frame 262 projects upwardly from the bottom plate 260, as does the rib 266. The perimeter frame 262 includes a leading portion 268, a trailing portion 270, and side portions 272, with the lip 264 projecting from the leading portion 268 opposite the bottom plate 260. The rib 266 is located between the leading and trialing portions 268, 270. As described below, the perimeter frame 262 provides attachment surfaces for assembly of the housing 116, whereas the rib 266 is configured to partially isolate flow channels defined within the housing 116 from one another.

Figures 5A, 5B:
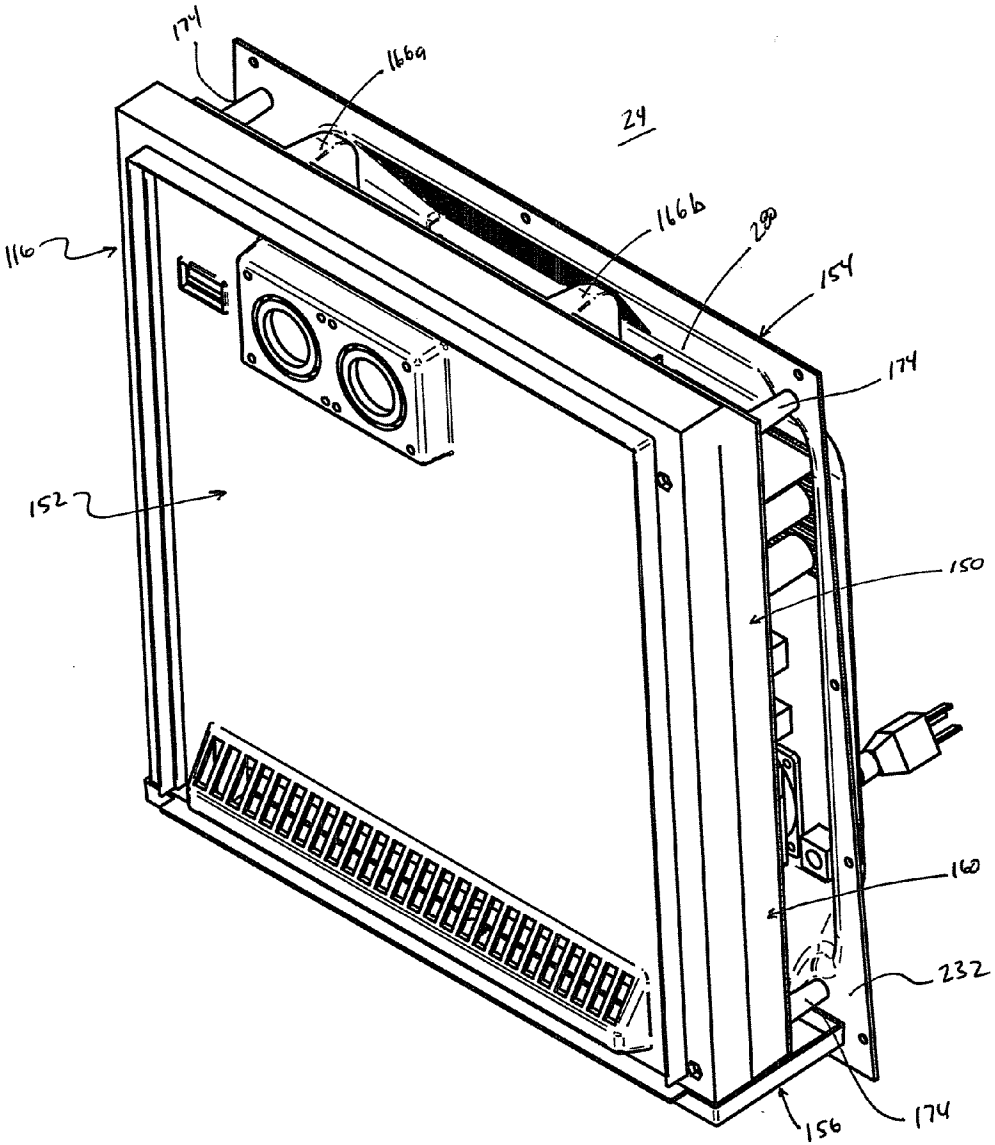
FIG. 5A is a front, perspective view of the unit of FIG. 4.
FIG. 5B is a rear prospective view of the unit of FIG. 4.
Figure 5B:
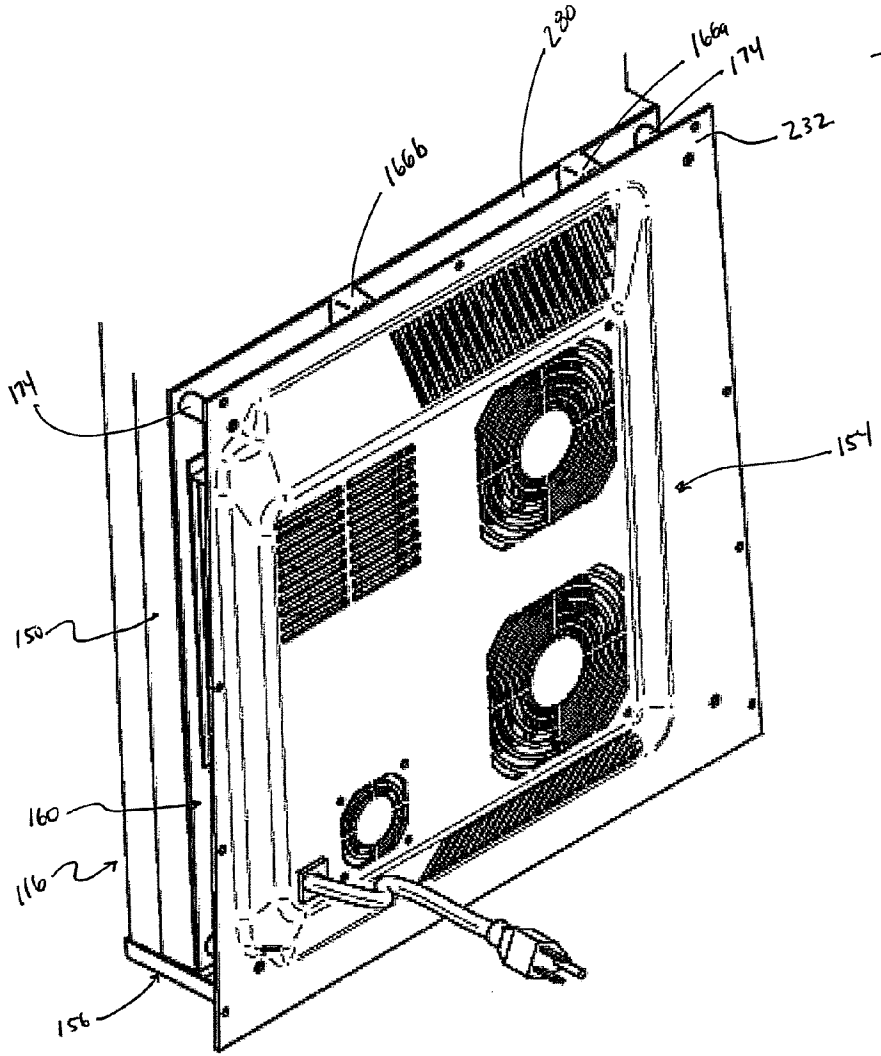
Figure 5C:
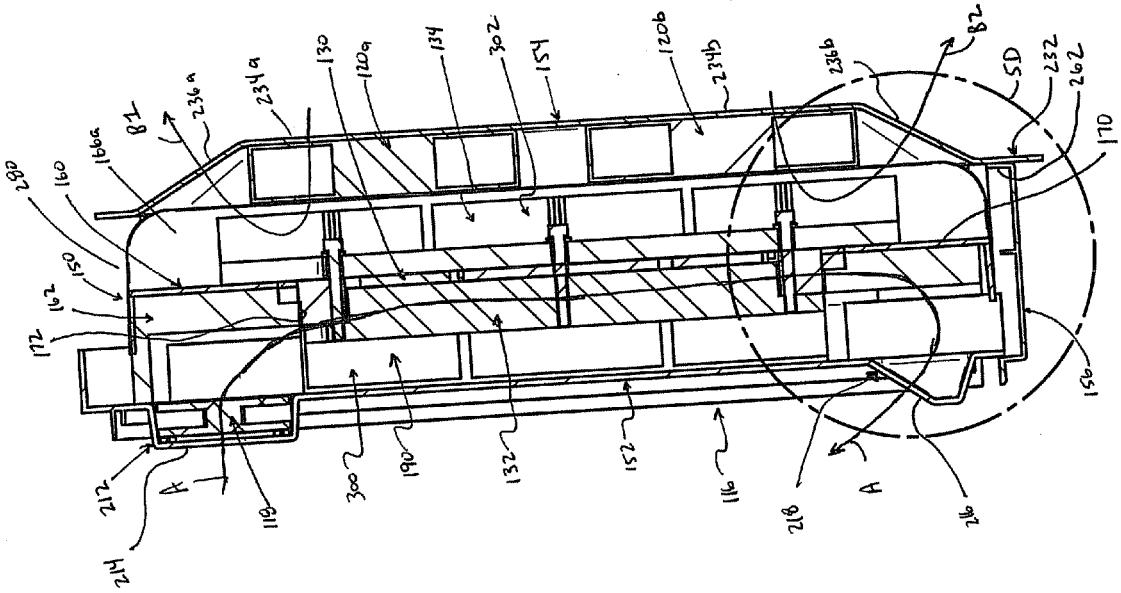
FIG. 5C is a cross-sectional view of the unit of FIG. 4.

Assembly of the cooling/heating unit 24 is shown in greater detail in FIGS. 5A-5C. The interior partition assembly 150 is constructed by mounting the support panel 160 to the isolation panel 162, for example via threaded fasteners. The interior partition assembly 150 is then mounted to the base 156, and the assembled thermoelectric device 130/first heat sink 132/second heat sink 134 mounted to the support panel 160. More particularly, and as best shown in FIG. 5C, the first heat sink 132 is inserted through the aperture 172, and thus into the cavity 190 of the isolation panel 162. The second heat sink 134 abuts against the trailing face 170 of the support panel 160. Upon final assembly, the columns 166*a*, 166*b* (the first column 166*a* being visible in the view of FIG. 5C) extend longitudinally beyond the corresponding side edges of the second heat sink 134.

The front side fan(s) 118 is disposed between the front panel 152 and the interior partition assembly 150, for example by mounting the front side fan(s) 118 within the pocket 212. The front panel 152 is assembled to the base 156, and is mounted to the isolation panel 162, for example via threaded fasteners (not shown). The power supply unit 112 (FIG. 4) and the controller 114 (FIG. 4) are mounted to the trailing face 170 of the support panel 160 and/or the rear panel 154, and electrically wired to one another. The rear side fan(s) 120 and the circuitry cooling fan 124 (FIG. 4) are assembled to the rear panel 154. Wiring from the various powered components (e.g., the fans 118, 120, 124, the thermoelectric device 130, and the display 122 (FIG. 4)) are electrically connected to the controller 114, followed by assembly of the rear panel 154 to the interior partition assembly 150 and the base 156. For example, threaded fasteners (not shown) can be employed to mount the flange 232 to the perimeter frame 262 of the base 156, as well as to the interior partition assembly 150 (via, for example, the posts 174 as shown in FIGS. 5A and 5B). Regardless, and as reflected in the views, the flange 232 extends laterally beyond a footprint of the interior partition assembly 150 and the base 156. An open slot 280 can be defined between the rear panel 154 and the support panel 160 upon final assembly. The slot 280 is open, for example, to the second heat sink 134. Alternatively, the slot 280 can be omitted and/or encompassed by an optional gasket (not shown).

Upon final assembly, the housing 116 establishes or forms a front side channel 300 and a rear side channel 302 as identified in FIG. 5C. The front side channel 300 is formed relative to the first heat sink 132, and is open to an exterior of the cooling/heating unit 24 at the inlet openings 214 and the outlet openings 216. More particularly, the front side channel 300 is defined between the front panel 152, the isolation panel 162, and the base 156, with the cavity 190 in the isolation panel 162 serving as the primary conduit. As shown by the arrow A in FIG. 5C, with operation of the front side fan(s) 118, airflow is drawn into the front side channel 300 via the inlet openings 214, across the first heat sink 132, and forced outwardly from the housing 116 via the outlet openings 216. In some embodiments, airflow exiting the outlet openings 216 is directed in a generally upward fashion (relative to the orientation of FIG. 5C) via the angled orientation of the shoulder segment 218. With this construction, then, airflow entering the front side channel 300 at the inlet openings 214 will experience a change in temperature upon thermally interfacing with the first heat sink 132. Thus, where the thermoelectric device 130 is operated to cool the first heat sink 132, airflow exhausted from the front side channel 300 (and into the product container 22) will be cooled; conversely, where the first heat sink 132 is heated by the thermoelectric device 130, the exhausted airflow will have an elevated temperature.

The rear side channel 302 includes the second heat sink 134, and provides a pathway for directing airflow across the second heat sink 134. As a point of reference, the second heat sink 134 will be heated or cooled in direct opposition to heating or cooling of the first heat sink 132. For long-term stability of the cooling/heating unit 24, then, it is desirable to force airflow across the second heat sink 134 to lessen a thermal load on the thermoelectric device 130 (and thus increase efficiency), but to do so in a manner whereby airflow affected by the second heat sink 134 has minimal interaction with airflow to or from the front side channel 300. With this in mind, the rear side channel 302 is defined by the support panel 160, the rear panel 154, and the base 156. The columns 166*a*, 166*b* (one of which is visible in the view of FIG. 5C) serve to further focus the rear side channel 302 across the second heat sink 134 and thermally isolate the second heat sink 134 from other components (e.g., the power supply unit 112 (FIG. 4)) by abutting the rear panel 154.

Figure 5D:
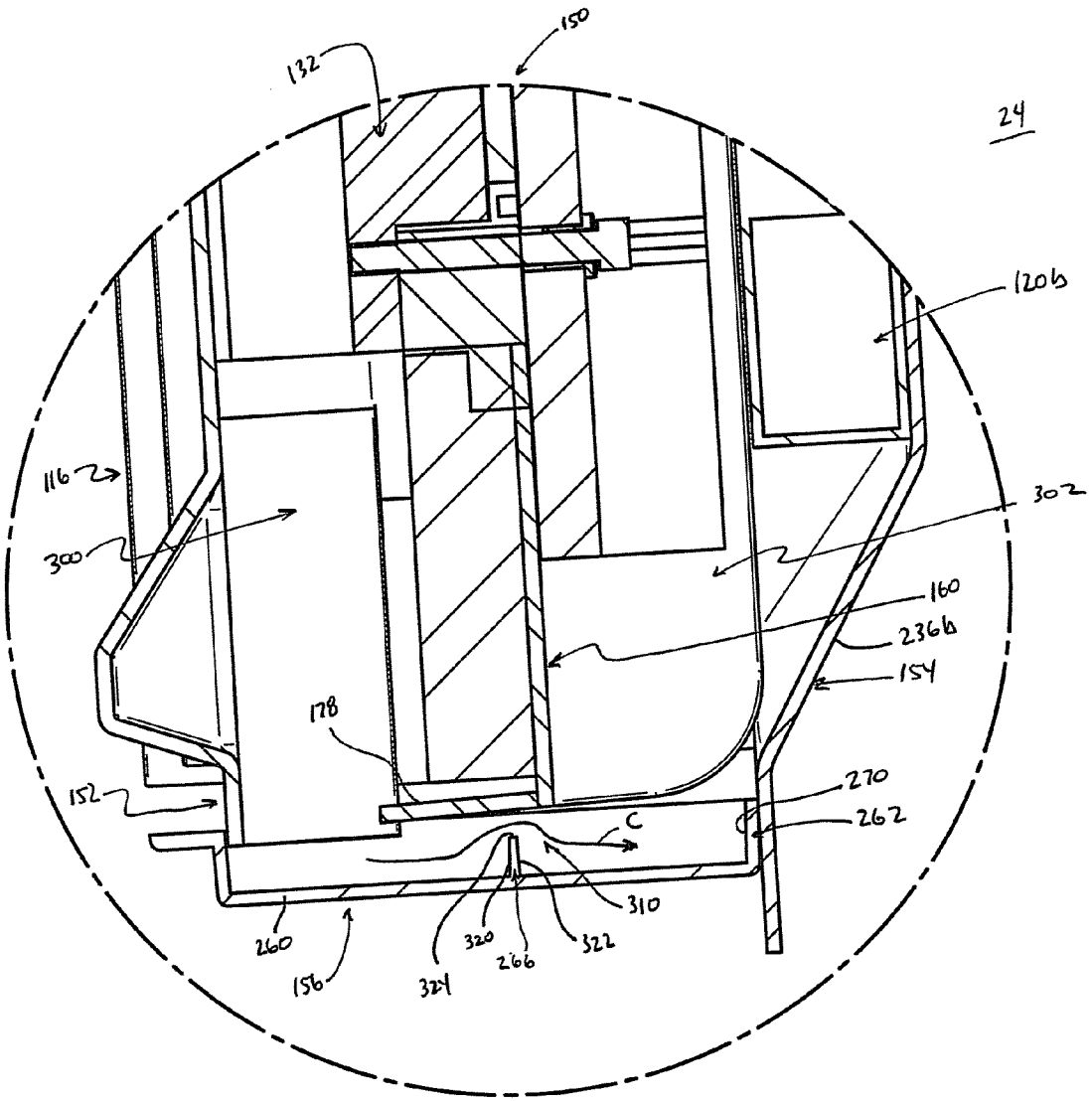
FIG. 5D is an enlarged, cross-sectional view of a portion of the unit of FIG. 5C.

In some embodiments, the rear side channel 302 establishes a first flow path (represented by the arrow B1 in FIG. 5C) relative to the first rear side fan 120*a*, and a second flow path (represented by the arrow B2 in FIG. 5C) relative to the second rear side fan 120*b*. With operation of the first rear side fan 120*a*, the first flow path B1 includes air being drawn into the rear side channel 302 via the first set of inlet openings 234*a*, across the second heat sink 134, and then exhausted from the housing 116 via the first set of outlet openings 236*a*. Operation of the second rear side fan 120*b* establishes the second flow pattern B2 in a similar manner relative to the second sets of inlet and outlet openings 234*b*, 236*b*. Regardless, the rear side fan(s) 120 is positioned in close proximity to the second heat sink 134, and forces incoming airflow in a direction generally perpendicular to a major plane of the second heat sink 134. Stated otherwise, the rear side fan(s) 120 is approximately parallel with the second heat sink 134. With this arrangement, forced airflow intimately interacts with the second heat sink 134, thereby enhancing desired thermal transfer.

Where the cooling/heating unit 24 is operated in a cooling mode (i.e., the thermoelectric device 130 operated to cool the first heat sink 132), condensation may accumulate along the first heat sink 132. In some embodiments, the housing 116 is adapted to remove condensation from the front side channel 300. In particular, and with reference to FIG. 5D, the housing 116 forms a condensation passageway 310 fluidly interconnecting the front side and rear side channels 300, 302. The condensation passageway 310 can be formed in a variety of manners, but in some embodiments is defined by the interior partition assembly 150 and the base 156.

For example, the rib 266 defines a front side 320, a rear side 322, and a leading edge 324 in extension from the bottom plate 260. A relationship between the base 156 and the interior partition assembly 150 is such that the leading edge 324 is aligned with, but spaced from the leg 178 of the support panel 160. With this arrangement, the condensation passageway 310 has a serpentine or tortuous pattern (reflected by an arrow C in FIG. 5D), with the spacing between the rib 266 and the front panel 152 serving as a first condensation passageway segment, the spacing between the rib 266 and the leg 178 serving as a second segment, and the spacing between the rib 266 and the trailing portion 270 of the frame 262 serving as a third segment. With this construction, significant airflow between the front side and rear side channels 300, 302 will not occur. However, as condensation from the first heat sink 132 accumulates within the base 156 (e.g., drips from the first heat sink 132 and accumulates along the bottom plate 260 between the front side 320 of the rib 266 and the front panel 152), the condensation level will rise above the leading edge 324. At this level, the accumulated condensation will drain through the condensation passageway 310 (i.e., between the leading edge 324 and the leg 178), and into the rear side channel 302 (e.g., accumulating along the bottom plate 260 between the rear side 322 of the rib 266 and the trailing portion 270 of the perimeter frame 262 and/or the rear panel 154). In this location, forced airflow from the second rear side fan 120*b* acts upon the accumulated condensation, and causes enhanced evaporation and exhausting thereof through the second set of outlet openings 236*b*.

Condensation management can be accomplished in a variety of fashions differing from those described above. For example, the leg segment 178 can be altered or eliminated, with other components establishing the tortuous flow pattern about the rib 266. Similarly, the rib 266 can be modified and/or replaced by one or more other bodies. Further, and as described below, the cooling/heating unit 24 is configured in combination with features of the product container 22 (FIG. 1) to facilitate formation of a liquid dam across the condensation passageway 310. In yet other embodiments, the product container 22 can be configured in combination with the cooling/heating unit 24 to complete the condensation passageway 310 as described below. Alternatively, the cooling/heating unit 24 need not incorporate a condensation removal feature.

Figure 6A:
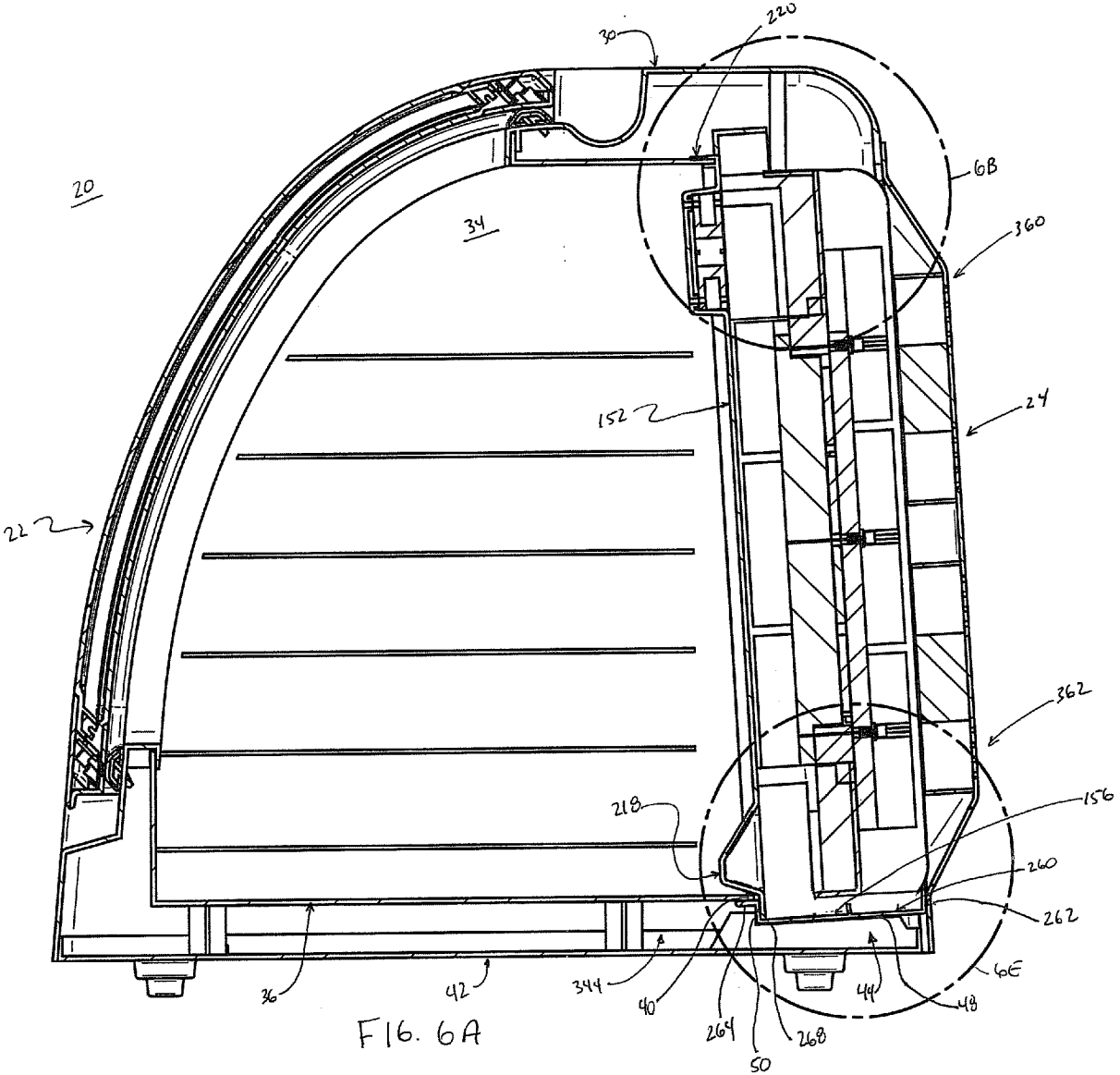
FIG. 6A is a cross-sectional view of the system of FIG. 1 upon final assembly.
Figure 6B:
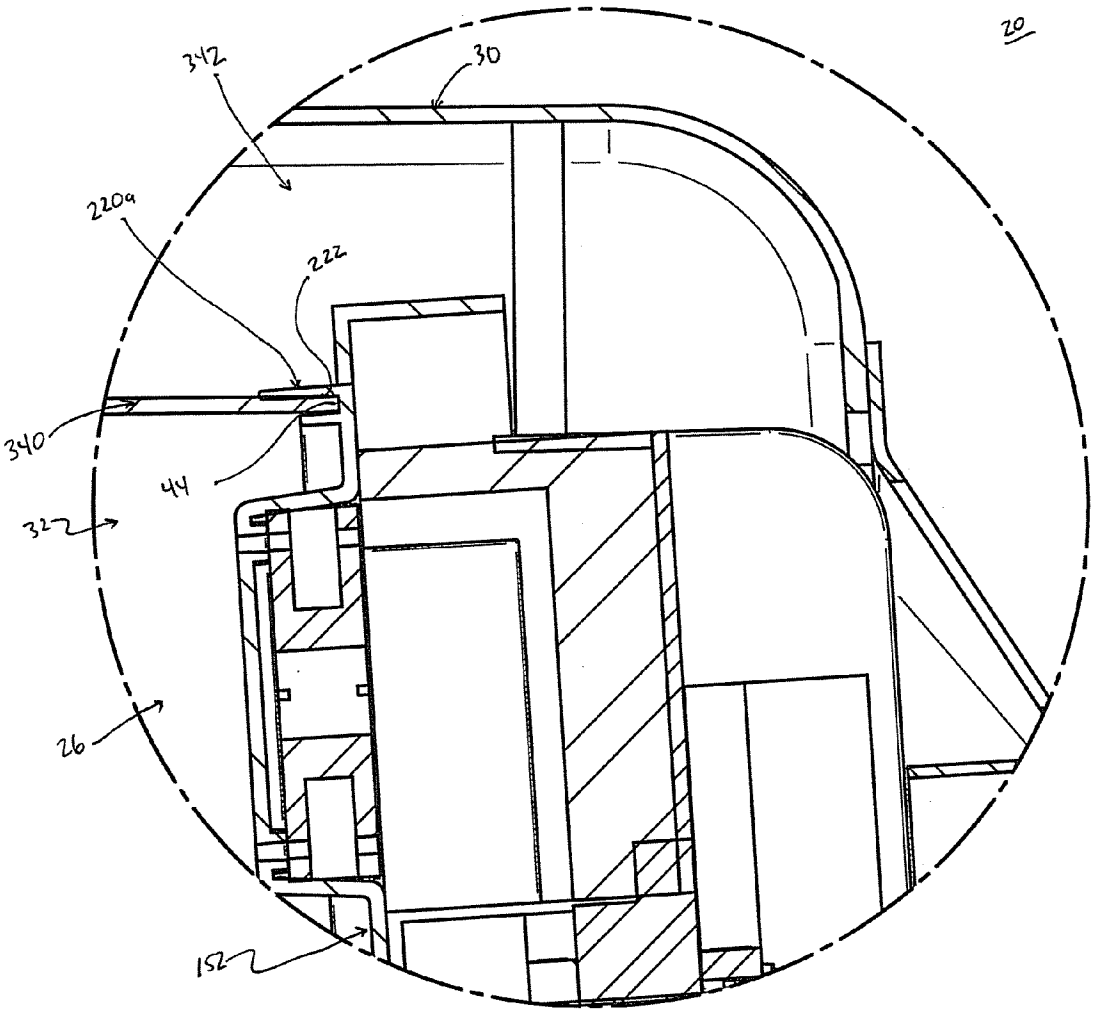
FIG. 6B is an enlarged view of a portion of the system of FIG. 6A.

Returning to FIG. 1, assembly of the system 20 entails simply inserting the cooling/heating unit 24 partially within the product container 22. In particular, the front panel 152 is directed into the access opening 28 and brought into engagement with the compartment 32. For example, and as shown in FIG. 6A, the engagement members 220 provided by the front panel 152 are assembled to, and frictionally engage the corresponding liner walls of the compartment 32. FIG. 6B illustrates one such interface in greater detail, with an upper liner 340 of the compartment 32 being frictionally engaged within the slot 222 of the upper engagement member 220*a*. The leading end 40 of the upper liner 340 thus abuts the front panel 152 within the slot 222, and a fluidly sealed-type arrangement is provided. That is to say, the upper engagement member 220*a* and the upper liner 340 combine to fluidly isolate the interior containment region 26 from a spacing 342 formed between the outer casing 30 and the upper liner 340. Though not shown in the views of FIGS. 6A and 6B, a similar, fluidly sealed-type interface is established between the opposing side liners 38 (FIG. 4) and the side engagement members 220*b*, 220*c* (FIG. 1). With specific reference to FIG. 6A, a fluidly sealed-type interface is also established between the platform 36 and the cooling/heating unit 24. More particularly, the lip 264 abuts against the platform 36, with the leading end 40 of the platform 36 contacting the front panel 152 (e.g., along the shoulder segment 218). Thus, the platform 36 is wedged between the lip 264 and the shoulder segment 218, fluidly isolating a spacing 344 between the platform 36 and the bottom wall 42.

Figure 6C:
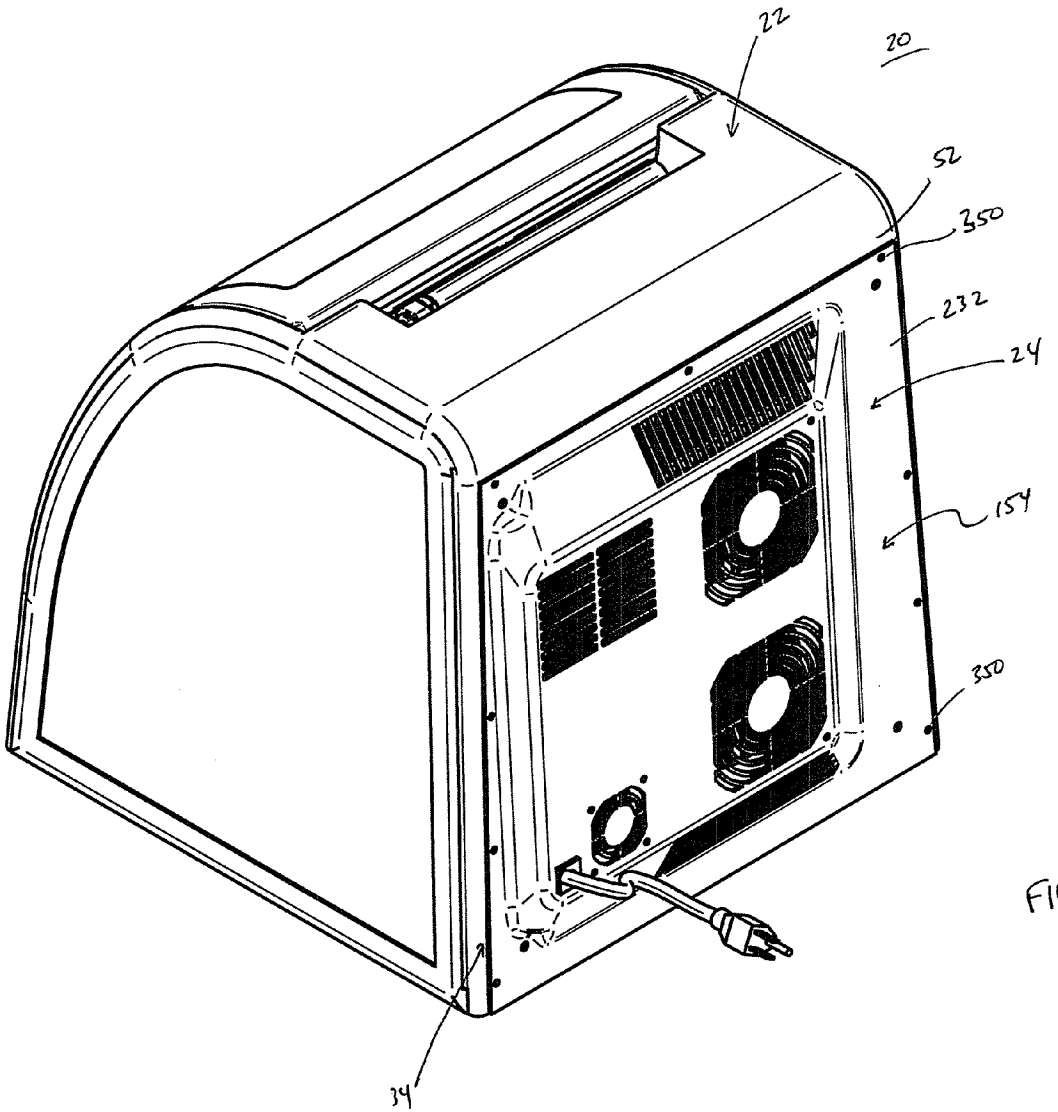
FIG. 6C is a rear perspective view of the system of FIG. 6A.

As shown in FIG. 6C, the cooling/heating unit 24 can be further secured to the product container 22 via fasteners 350 interconnecting the flange 232 of the rear panel 154 with the trailing surface 52 of the rear wall 32.

Figure 6D:
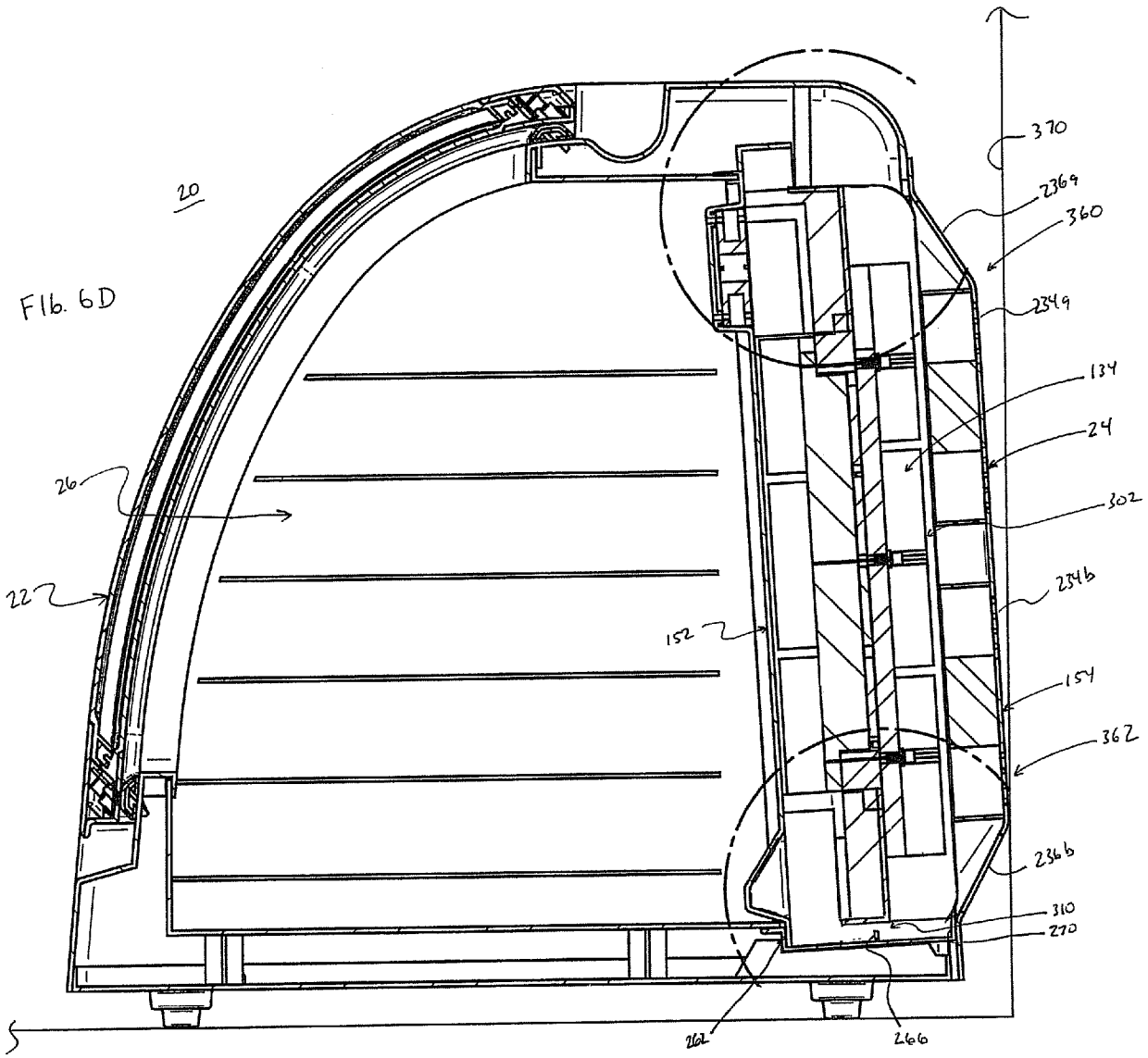
FIG. 6D illustrates placement of the system of FIG. 6A to an external support structure.

With embodiments in which the product container 22 includes the shoulders 44, assembly of the cooling/heating unit 24 includes the bottom plate 260 being disposed on the support surface 48. The leading portion 268 of the perimeter frame 262 bears against the stop surface 50 to better ensure desired arrangement of the lip 264/shoulder 218 relative to the platform 36*a* s described above. With this in mind, the support surface 48 is arranged to effectuate a "tilt" of the cooling/heating unit 24 relative to the product container 22. For example, the support surface 48 maintains the base 156 in a non-parallel plane relative to the platform 36 of the compartment 32, as well as relative to the bottom wall 42 of the outer casing 30. Thus, relative to the upright orientation of FIG. 6A in which the platform 36 and the bottom wall 42 are horizontally arranged, the cooling/heating unit 24 is spatially oriented such that an upper region 360 is forward of a lower region 362. With this one acceptable mounting technique, were an attempt made to position the system 20 against an upright structure 370 (e.g., a wall) as shown in FIG. 6D, while the rear panel 154 may contact the structure 370 along the lower region 362, the tilted arrangement ensures existence of a spacing between the structure 370 and the rear panel 154. As such, the inlet openings 234*a*, 234*b* along the rear panel 154, as well as at least some of the outlet openings 236 (e.g., the first outlet openings 236*a*) will not be overtly obstructed by the structure 370 such that desired airflow thought the rear side channel 302 and across the second heat sink 134 can occur.

Figure 6E:
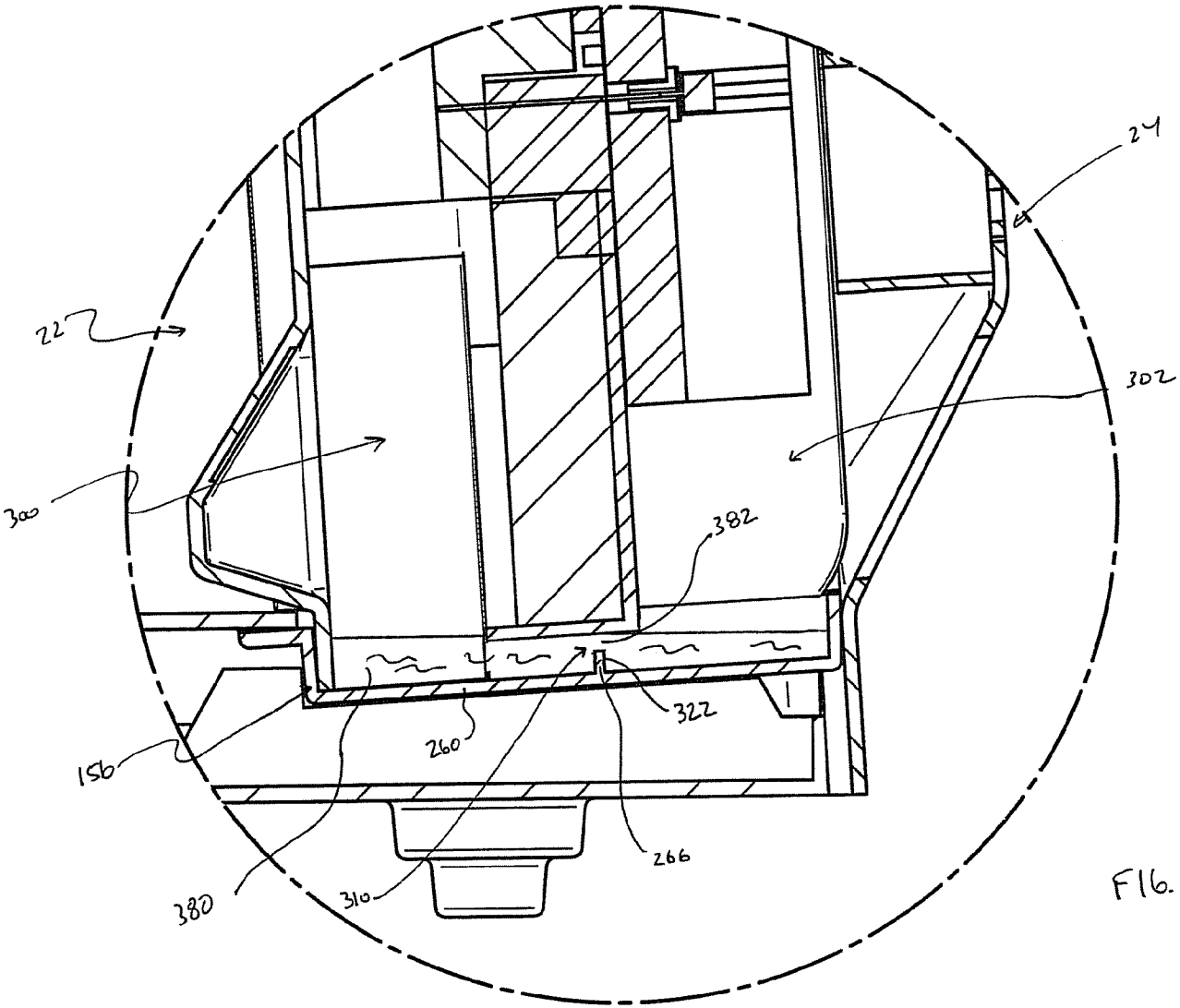
FIG. 6E illustrates operation of the system of FIG. 6A in managing condensation.

Upon completion of assembly, product (not shown) is loaded into the interior containment region 26 of the product container 22. The cooling/heating unit 24 is then operated to cool and/or heat the loaded product as described above. For example, where cooling of the contained product is desired, cooled air is generated by the cooling/heating unit 24 and continuously directed into and recycled from, the interior containment region 26. Heating of the contained product occurs in a similar fashion. In addition to ensuring necessary airflow into and out of the rear side channel 302, the optional tilted arrangement of the cooling/heating unit 24 relative to the product container 22 (and thus relative to horizontal) enhances condensation management via the condensation passageway 310. In particular, a volume of condensation liquid will accumulate between the rib 266 and the front panel 152. As additional quantities of the condensation liquid accumulate between the rib 266 and the front panel 152, the liquid level rises above the rib 266 and ultimately flows through the condensation passageway 310 and into the space between the rib 266 and the trailing portion 270 of the perimeter frame 262. As shown in FIG. 6E, accumulated condensation liquid 380 along the bottom plate 260 is forced to reside against the rear side 322 of the rib 266 due to the tilted arrangement of the base 156, thereby establishing a liquid dam 382 across the condensation passageway 310. The liquid dam 382, in turn, serves to impede undesired airflow from the rear side channel 302 to the front side channel 300 (and vice-versa). Effectively, then, the tilted arrangement of the base 156 serves to more thoroughly isolate the channels 300, 302. In other words, were the bottom plate 260 horizontally oriented, the accumulated condensation liquid 380 would flow toward the trailing portion 270 and not necessarily "fill" the condensation passageway 310 (i.e., the liquid dam 382 may not be formed). Alternatively, other spatial orientations of the base 156 upon assembly to the product container 22 are also acceptable.

Figure 7:
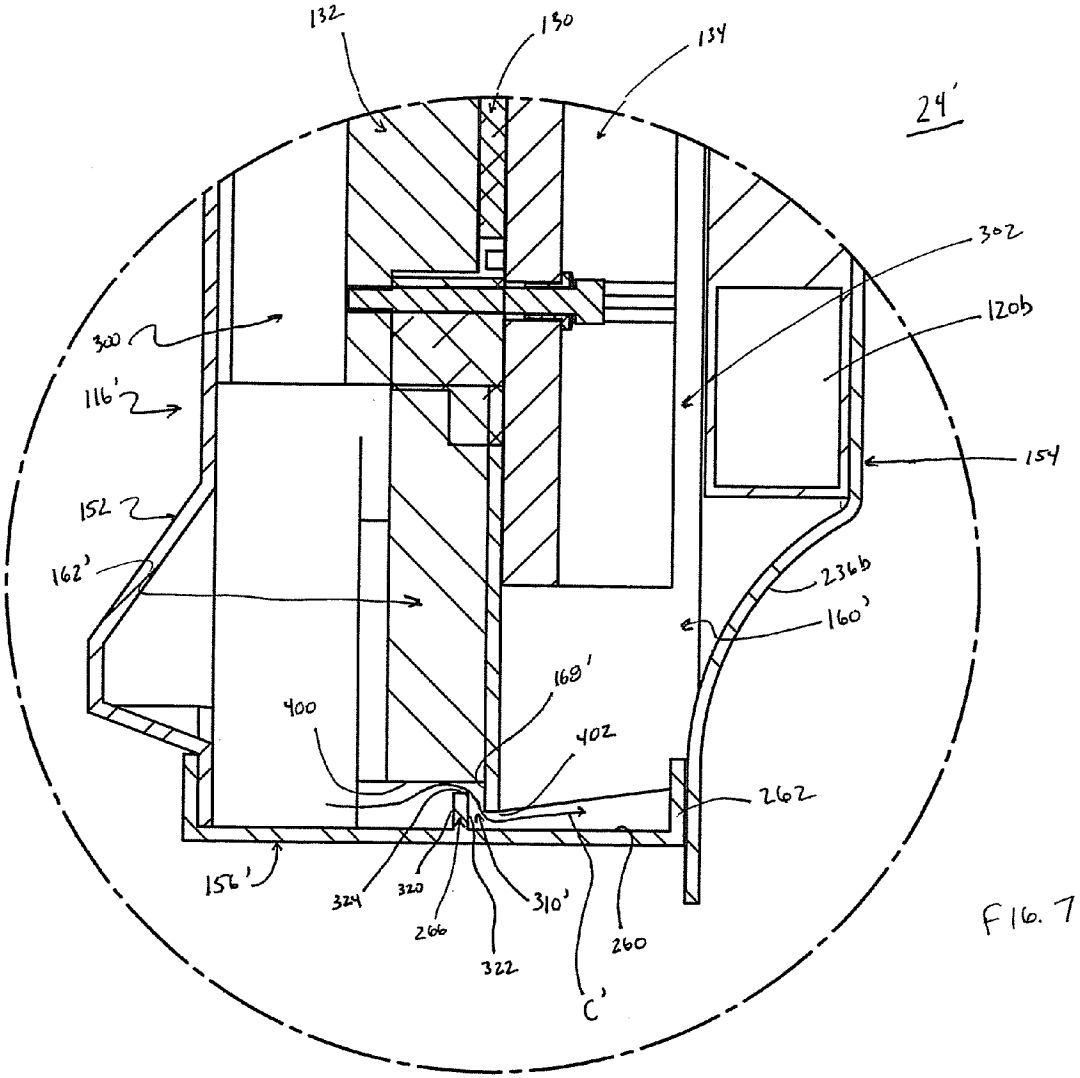
FIG. 7 is an enlarged, cross-sectional view of a portion of another temperature controlled merchandising system, including another cooling/heating unit in accordance with principles of the present disclosure.

As indicated above, the cooling/heating unit 24 can incorporate other structural configurations that facilitate formation of the condensation passageway 310. For example, FIG. 7 illustrates a portion of an alternative cooling/heating unit 24' forming a condensation passageway 310'. The cooling/heating unit 24' is highly akin to the cooling/heating unit 24 (FIG. 5D) described above, and includes a housing 116' maintaining the thermoelectric device 130, and the first and second heat sinks 132, 134. The housing 116' includes the front and rear panels 152, 154 as previously described, as well as a base 156', a support panel 160', and an isolation panel 162'. The base 156' forms the rib 266 that defines the front side 320, the rear side 322, and the leading edge 324. With these designations in mind, construction of the housing 116' includes the leading edge 324 being aligned with, but spaced from, a lower edge 400 of the isolation panel 162'. A bottom edge 402 of the support panel 160' extends below the leading edge 324 of the rib 266 (relative to the orientation of FIG. 7), but is spaced from the bottom plate 260 of the base 156'. Finally, a gap is established between the rear side 322 of the rib 266 and a leading face 168' of the support panel 160'.

With the above arrangement, the condensation passageway 310' has a serpentine or tortuous pattern (reflected by an arrow C' in FIG. 7), with the space between the rib 266 and the front panel 152 serving as a first condensation passageway segment, the space between the rib 266 and the lower edge 400 serving as a second segment, the space between the rib 266 and the leading face 168' serving as a third segment, and the space between the rib 266 and the perimeter frame 262 serving as a fourth segment. With this construction, significant airflow between the front side and rear side channels 300, 302 will not occur. However, as condensation from the first heat sink 132 accumulates within the base 156' (e.g., drips from the first heat sink 132 and accumulates along the bottom plate 260 between the front side 320 of the rib 266 and the front panel 152), the condensation level will rise above the leading edge 324. At this level, the accumulated condensation will drain through the condensation passageway 310' (i.e., between the rear side 322 of the rib 266 and the leading face 168' of the support panel 160'), and into the rear side channel 302 (e.g., accumulating along the bottom plate 260 between the rear side 322 of the rib 266 and the perimeter frame 262 and/or the rear panel 154). In this location, forced airflow from the second rear side fan 120*b* acts upon the accumulated condensation, and causes enhanced evaporation and exhausting thereof through the second set of outlet openings 236*b*.

Returning to FIG. 1, with the cooling/heating unit 24, 24' (FIG. 7) of the present disclosure, a wide variety of product contains designs can be utilized. The cooling/heating unit 24, 24' is effectively a modular device, with the only design constraint associated with the product container 22 being a provision of an opening (e.g., the access opening 28) having a size and shape commensurate with that of the cooling/heating unit 24. Thus, for example, the system 20 can be designed by first receiving general (or specific) design preferences from an end user (e.g., intended location, desired exterior dimensions, use with related accessories such as a stand, etc.). With these end user preferences and the "standard" opening size and shape constraints in mind, the product container 22 can then be manufactured, and the pre-made cooling/heating unit 24 simply assembled thereto.

Figure 8:
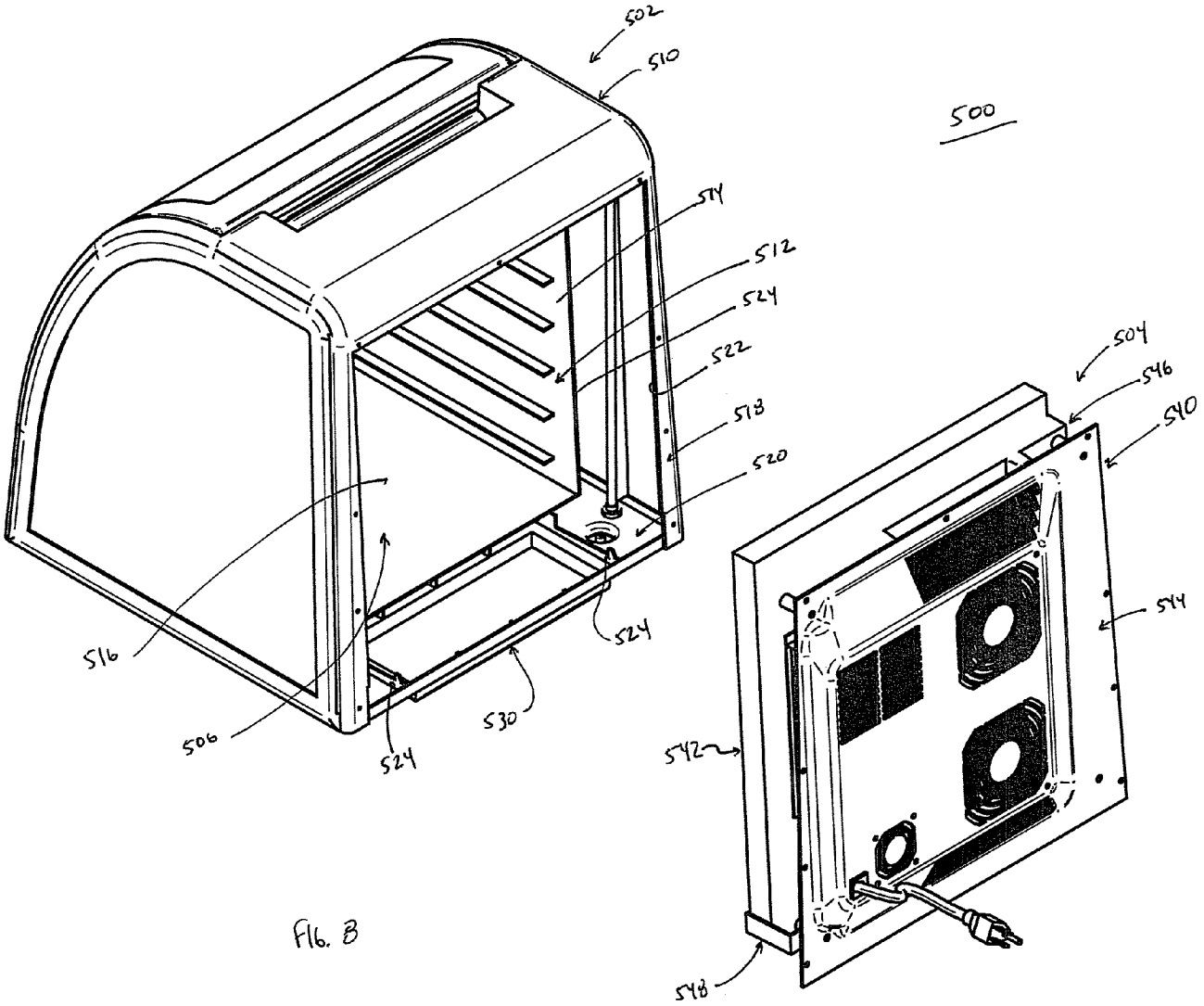
FIG. 8 is a perspective, exploded view of another temperature controlled merchandizing system in accordance with the present disclosure.

Although the cooling/heating unit 24, 24' has been described as completely forming the condensation passageway 310, 310', in other embodiments, the product container 22 incorporates features that facilitate fluid communication between the front side and rear side channels 300, 302. For example, FIG. 8 illustrates another portable, temperature controlled merchandizing system 500 in accordance with aspects of the present disclosure. The system 500 is akin to the system 20 (FIG. 1) previously described and generally includes a product container 502 and a cooling/heating unit 504. Once again, the cooling/heating unit 504 is removably assembled to the product container 502, and incorporates thermoelectric technology operable to alter a temperature of an interior containment region 506 of the product container 502, and thus product (not shown) contained therein.

As with previous embodiments, the product container 502 can have a wide variety of different sizes/dimensions and/or shapes appropriate for a particular in-store merchandizing application; thus, the but one exemplary configuration of FIG. 8 is in no way limiting. In some constructions, the product container 502 includes an outer casing 510 and an interior compartment 512. The interior compartment 512 is highly analogous to the interior compartment 32 (FIG. 1) previously described, and includes liner walls 514 (one of which is visible in FIG. 8) and a platform 516 that combine to define the interior containment region 506. The outer casing 510 surrounds the interior compartment 512, and includes a rear wall 518 and a bottom wall 520. The rear wall 518 defines an access opening 522 through which the cooling/heating unit 504 is assembled to the interior compartment 512, and thus the interior containment region 506. The bottom wall 520 extends below the platform 516, and establishes a spacing between a leading end 524 of the interior compartment 512 and the access opening 522. In this regard, the outer casing 510 can include one or more shoulders 526 that are akin to the shoulders 44 (FIG. 1) previously described that serve to support the cooling/heating unit 504 at a desired orientation relative to the product container 502.

The above-described features of the product container 502 can be identical to those associated with the product container 22 (FIG. 1) previously described. In addition, the product container 502 includes or forms a well 530. The well 530 can be formed as a downward projection from the bottom wall 520 (i.e., in a direction opposite a direction of extension of the shoulders 524 relative to the bottom wall 520). The well 530 is located between the leading end 524 of the interior compartment 512 and the access opening 522. As made clear below, the well 530 is configured in accordance with features of the cooling/heating unit 504 in completing a condensation passageway upon final assembly of the merchandising system 500.

The cooling/heating unit 504 is, in many respects, identical to the cooling/heating unit 24 (FIG. 1) previously described. Thus, the cooling/heating unit 504 includes a housing 540 maintaining various components such as a thermoelectric assembly, a power supply unit, a controller, and fans. It will be understood that these internal components are hidden in the view of FIG. 8, but can be identical to the thermoelectric assembly 110, power supply unit 112, controller 114, and fans 118, 120 previously described with respect to FIG. 4. Regardless, the housing 540 includes a front panel 542, a rear panel 544, an interior partition assembly 546 (referenced generally), and a base 548. The housing components 542-548 are highly akin to the corresponding components of the housing 116 (FIG. 4). In some embodiments, however, the base 548 incorporates one or more additional features.

Figure 9B:
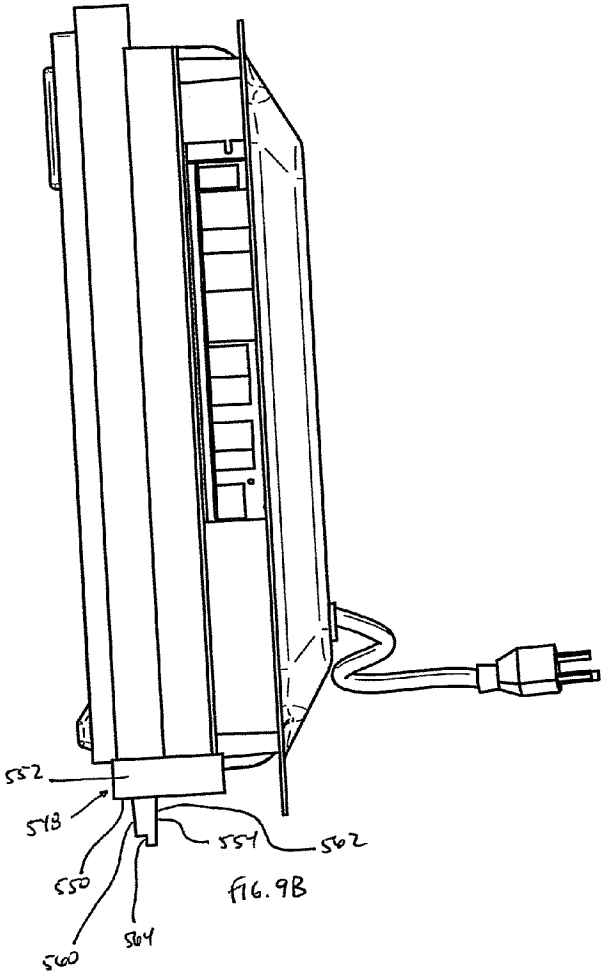
FIG. 9B is a side view of the cooling/heating unit of FIG. 9A.
Figure 9A:
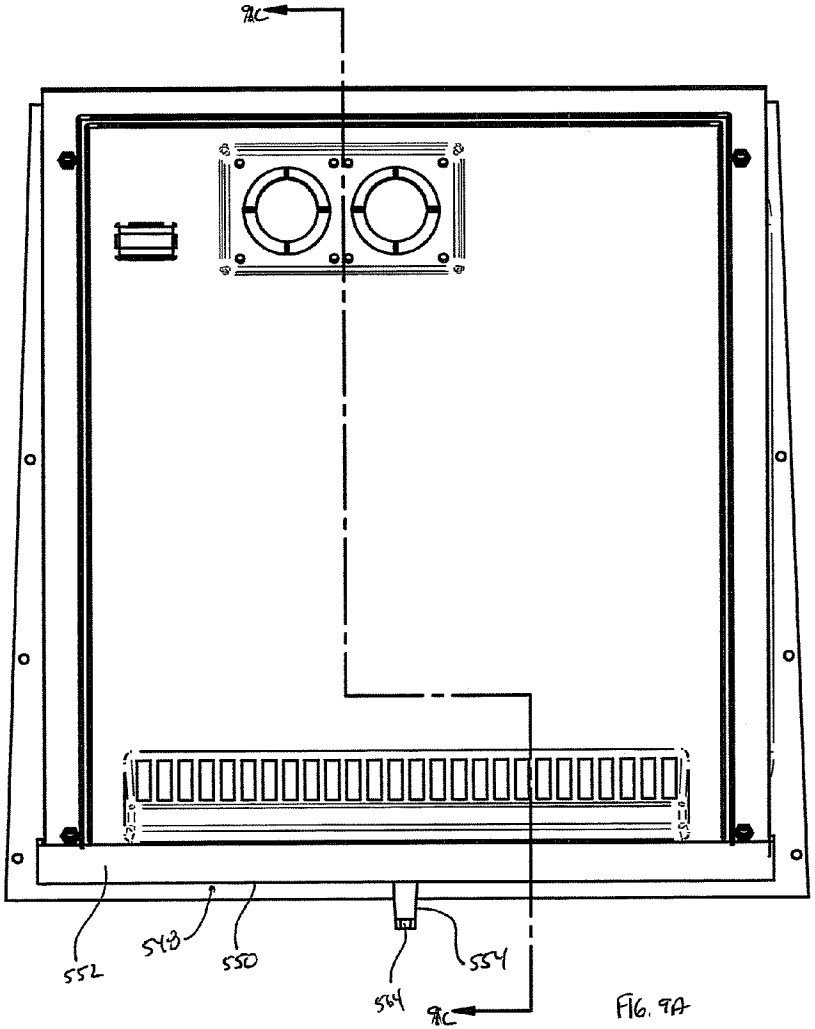
FIG. 9A is a front plan view of a cooling/heating unit component of the system of FIG. 8.
Figure 9C:
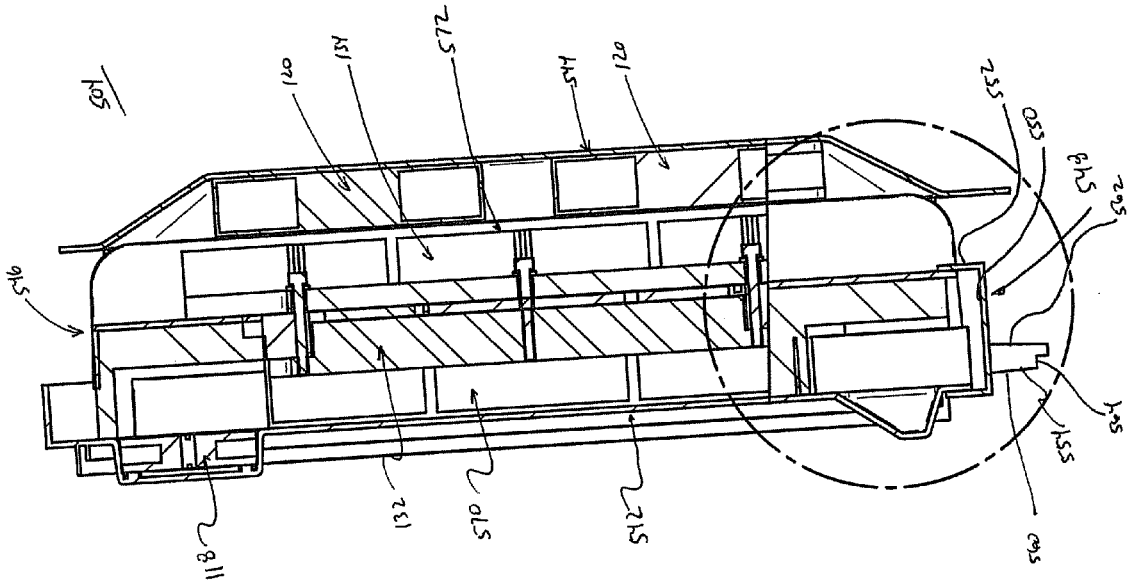
FIG. 9C is a cross-sectional view of the heating/cooling unit of FIG. 9A, taken along the line 9C-9C.

More particularly, and with reference to FIGS. 9A-9C, the base 548 includes a bottom plate 550, a perimeter frame 552, and a drainage tube 554. The perimeter frame 552 extends upwardly from the bottom plate 550, whereas the drainage tube 554 extends downwardly from the bottom plate 550. As best shown in FIG. 9A, the drainage tube 554 can be centered relative to a length of the bottom plate 550, although other locations are also acceptable. Regardless, the drainage tube 554 forms a lumen (not shown) that is fluidly open to an interior of the bottom plate 550 (i.e., extends through a thickness of the bottom plate 550) and establishes a segment of a condensation passageway. As best shown in FIGS. 9B and 9C, the drainage tube 554 can be described as defining a leading side 560 and a trailing side 562. For reasons made clear below, in some constructions, the drainage tube 554 is configured to incorporate a notch 564 at the leading side 560 opposite the base plate 550. Alternatively, however, the drainage tube 554 can have a continuous or uniform outer diameter.

Assembly of the cooling/heating unit 504 is akin to that of the cooling/heating unit 24 (FIG. 5C). Thus, and with specific reference to FIG. 9C, the perimeter frame 552 of the base 548 is assembled to the front panel 542 and the interior partition assembly 546. The front panel 542, the interior partition assembly 546, and the base 548 combine to define a front side channel 570 within which the first heat sink 132 and the front side fan(s) 118 are disposed. Conversely, the rear panel 544 and the interior partition assembly 546 combine to define a rear side channel 572 within which the second heat sink 134 and the rear side fan(s) 120 are disposed. The base 548 effectively closes the front side channel 570 relative to the rear side channel 572, with the drainage tube 544 establishing an exit path or passageway segment for accumulated condensation from the first heat sink 132.

Figure 10A:
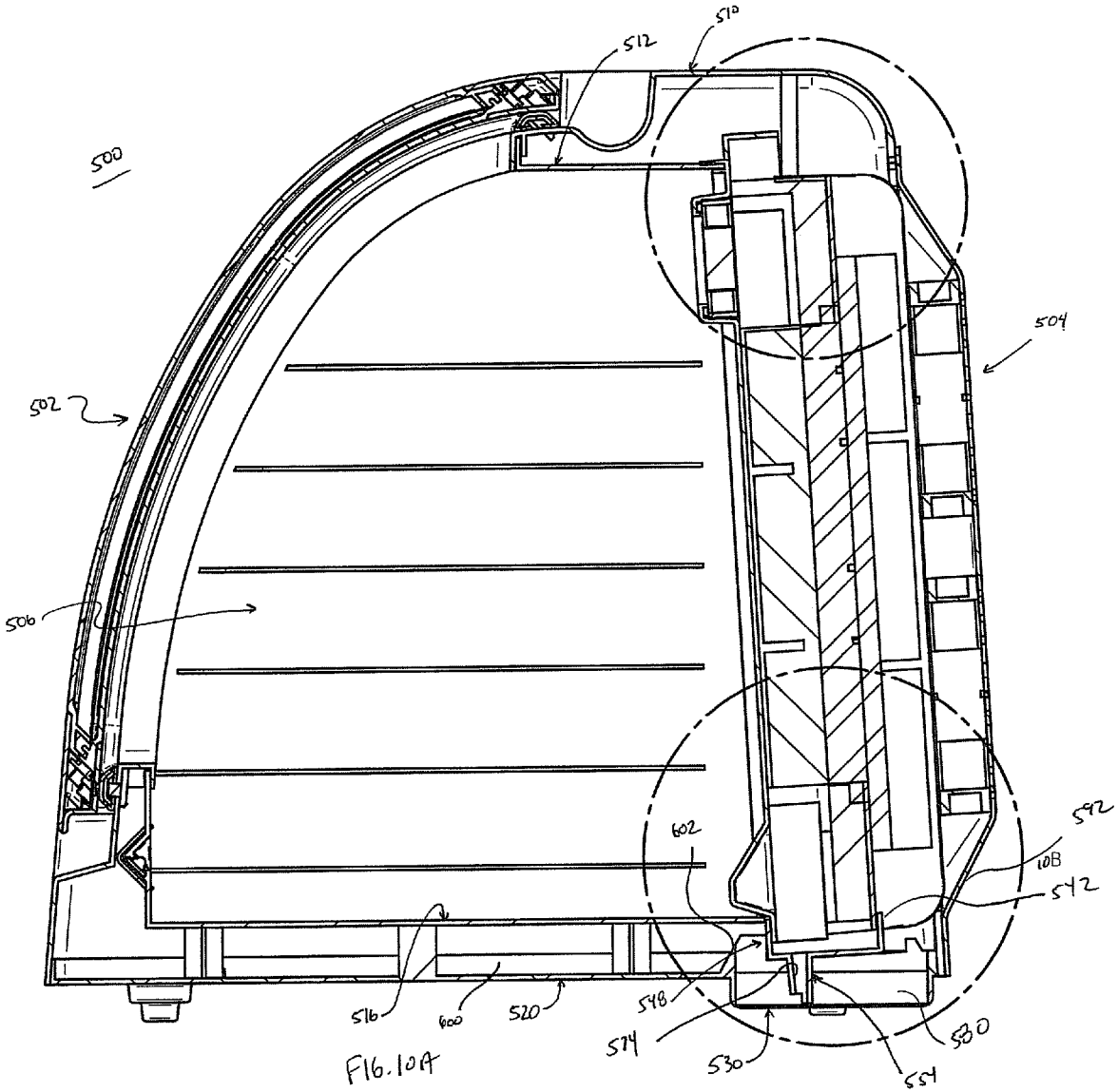
FIG. 10A is a cross-sectional view of the system of FIG. 8 upon final assembly.
Figure 10B:
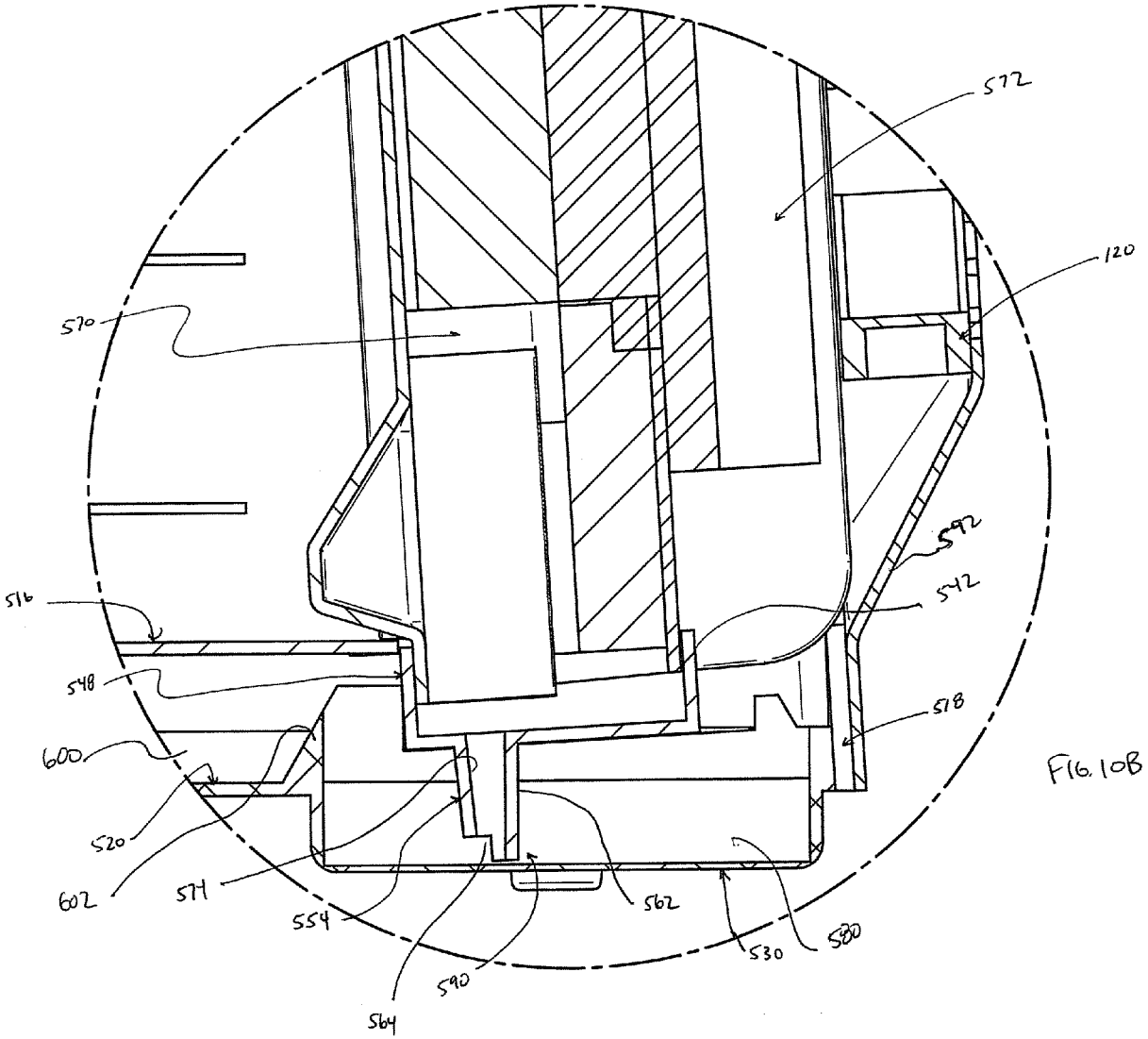
FIG. 10B is an enlarged cross-sectional view of a portion of the system of FIG. 10A.

As shown in FIGS. 10A and 10B, upon assembly of the cooling/heating unit 504 to the product container 502, the front panel 542 is mounted to the interior compartment 512 in the manner previously described with respect to the system 20 (FIG. 6A). With the merchandising system 500, however, the shoulders 524 (one of which is shown in FIGS. 10A and 10B) receive and support the base 548 such that the drainage tube 554 is located within the well 530 of the product container 502. Thus, the lumen 574 of the drainage tube 554 establishes fluid communication between the front side channel 570 and an internal chamber 580 of the well 530. The rear side channel 572 is similarly open to the chamber 580, for example via a spacing between the perimeter frame 552 of the base 548 and the rear wall 518 of the product container 502. Effectively, then, a condensation passageway 590 is established between the front side and rear side channels 570, 572 via the drainage tube 554 and the well 530, with the drainage tube 534 serving as a first condensation passageway segment, and the wall 530 serving as a second segment.

During operation of the cooling/heating unit 504, condensation created along the first heat sink 132 drips onto the bottom plate 550 of the base 548. Accumulated condensation liquid is directed through the drainage tube 554 and into the chamber 580 of the well 530. Because the rear side channel 572 is fluidly open to the chamber 580, airflow generated by the rear side fans 120 is directed onto the accumulated liquid within the chamber 580, causing evaporation to occur, with the evaporated liquid being exhausted from the system 500 via outlet openings 592 formed by the rear side panel 544.

In some constructions, the notch 564 formed in the drainage tube 544 facilitates clearance of the drainage tube 544 within the well 530 in conjunction with the tilted orientation of the cooling/heating unit 504. In addition, by forming the trailing side 562 of the drainage tube 554 to encompass nearly an entire depth of the well 530, the trailing side 562 effectively blocks airflow from the rear side channel 572 from entering the lumen 574 of the drainage tube 554. Airflow isolation of the front and rear side channels 570, 572 can be further enhanced by placement of a blocking material (not shown), for example an anti-bacterial sponge, within the lumen 574. The material allows liquid to flow through the drainage tube 554 as desired, but inhibits airflow therethrough. As a point of reference, FIGS. 10A and 10B illustrate a spacing 600 between the platform 516 of the interior compartment 512 and the bottom wall 520 of the outer casing 510. A front side wall 602 of the well 530 extends above the bottom wall 520, thereby partially inhibiting liquid flow into the spacing 600. In addition, the spacing 600 can be filled with an insulating material (e.g., a blown insulation) that further limits the flow of liquid into the spacing 600.

The cooling/heating units, and related merchandizing systems, of the present disclosure provide a marked improvement over previous designs. All necessary components for powering (and controlling) operation of the thermoelectric device and fans are provided in a single, self-contained heating/cooling unit such that a user need only mount the cooling/heating unit to the product container and plug in the power supply to a wall source. No other "in the field" wiring is required. Thus, the cooling/heating unit of the present disclosure provides manufacturers with enhanced flexibility in meeting customer preferences on a cost-effective basis. The resultant product container can range from relatively small sizes (e.g., countertop- or shelf-style containers) to relatively large sizes (e.g., akin to a coffin-style or upright freezer).

Although the present disclosure has been described with reference to preferred embodiments, workers skilled in the art will recognize that changes can be made in form and detail without departing from the spirit and scope of the present disclosure.

What is claimed is:

1. A portable cooling/heating unit for removable mounting to a product container in cooling/heating an interior containment region of the product container, the unit comprising:

a housing including a front panel and a rear panel assembled to a base, the housing forming:

a front side channel at least partially defined by the front panel, a rear side channel at least partially defined by the rear panel, a condensation passageway segment at least partially defined by the base as part of a condensation passageway that fluidly connects the front and rear side channels;

wherein the base includes:

a bottom plate defining a leading side assembled to the front panel and a trailing side assembled to the rear panel; and a rib projecting from the bottom plate intermediate the leading and trailing sides;

wherein the rib partially separates the front and rear side channels in defining a portion of the condensation passageway;

a thermoelectric assembly maintained by the housing and including:

a thermoelectric device forming opposing, first and second surfaces, a first heat sink thermally connected to the first surface and maintained within the front side channel, a second heat sink thermally connected to the second surface and maintained within the rear side channel;

a front side fan disposed within the front side channel, wherein relative to an upright orientation of the unit, the front side fan is above the first heat sink, and the first heat sink is above the condensation passageway;

and a rear side fan disposed within the rear side channel;

wherein the unit is configured for removable assembly to a product container such that the front side channel is fluidly open to an interior containment region of the product container and condensation generated at the first heat sink during operation of the thermoelectric device is directed from the front side channel to the rear side channel via the condensation passageway.

2. The cooling/heating unit of claim 1, wherein the housing further includes an interior partition assembly maintaining the first and second heat sinks relative to the base, and further wherein the condensation passageway segment is defined between the base and the interior partition assembly.

3. The cooling/heating unit of claim 2, wherein the unit is further configured such that condensation from the first heat sink pools between the rib and the leading side, and then flows over the rib to a spacing between the rib and the trailing side.

4. The cooling/heating unit of claim 1, wherein the condensation passageway segment is formed by a drainage tube provided with the base.

5. The cooling/heating unit of claim 1, further comprising:

a power supply unit maintained within the housing and electrically communicating with the thermoelectric device and the fans, the power supply unit configured to convert AC power to DC power for powering operation of the thermoelectric device.

6. The cooling/heating unit of claim 5, further comprising:

a controller maintained within the housing and electrically connected to the power supply unit, the controller adapted to control delivery of power from the power supply unit to the thermoelectric device and the fans.

7. The cooling/heating unit of claim 5, further comprising:

a circuitry cooling fan maintained by the housing adjacent the power supply unit.

8. The cooling/heating unit of claim 1, wherein the front panel forms first and second exterior openings to the front side channel.

9. The cooling/heating unit of claim 8, wherein the housing further includes an interior partition assembly mounted between the front and rear panels and combining with the front panel to define the front side channel as including:

a leading segment extending from the first exterior opening and containing the front side fan;

an intermediate segment extending from the leading segment and containing the first heat sink; and a trailing segment extending from the intermediate segment to the second exterior opening.

10. The cooling/heating unit of claim 9, wherein operation of the first fan generates an airflow direction from the leading segment to the trailing segment, the front side channel defining a length in a direction of the airflow direction and a width in a direction perpendicular to the length, and further wherein the trailing segment expands in the width direction in extension from the intermediate segment.

11. The cooling/heating unit of claim 9, wherein the front panel includes a front face defining a major plane and a pocket formed as a projection from the front face outwardly from the major plane, the pocket sized to receive the front side fan.

12. The cooling/heating unit of claim 9, wherein the front panel includes a planar portion defining a major plane of the front panel and a shoulder extending from the planar portion in a plane non-parallel and non-perpendicular with the major plane, the second exterior opening to the front side channel being formed in the shoulder.

13. The cooling/heating unit of claim 1, wherein the front panel defines a front face, a rear face, and first and second exterior openings to the front side channel, and further wherein the housing further includes:

an isolation panel defining a cavity;

wherein upon assembly of the front panel and the isolation panel to the base, the isolation panel abuts the rear face to define the front side channel along the cavity and the rear face; and a support panel mounted to the isolation panel opposite the front panel and forming an aperture sized in accordance with the first heat sink such that upon final assembly, the support panel maintains the first heat sink within the cavity.

14. The cooling/heating unit of claim 1, wherein the rear side fan is positioned immediately adjacent the second heat sink and establishes an incoming airflow pattern perpendicular to a major plane of the second heat sink.

15. A portable, temperature controlled merchandizing system comprising:

a first product container forming an interior containment region for containing product and exteriorly accessible via an access opening; and a cooling/heating unit removably assembled to the product container, the unit comprising:

a housing including a front panel and a rear panel assembled to a base, the housing forming:

a front side channel at least partially defined by the front panel, a rear side channel at least partially defined by the rear panel, a condensation passageway segment at least partially defined by the base, wherein the base includes:

a bottom plate defining a leading side assembled to the front panel and a trailing side assembled to the rear panel; and a rib projecting from the bottom plate intermediate the leading and trailing sides;

wherein the rib partially separates the front and rear side channels in defining a portion of the condensation passageway a thermoelectric assembly maintained by the housing and including:

a thermoelectric device forming opposing, first and second surfaces, a first heat sink thermally connected to the first surface and maintained within the front side channel, a second heat sink thermally connected to the second surface and maintained within the rear side channel, a front side fan disposed within the front side channel, a rear side fan disposed within the rear side channel;

wherein the cooling/heating unit is removably assembled to the product container via mounting of the housing to the access opening such that the front side channel is fluidly open to the interior containment region and condensation generated at the first heat sink during operation of the thermoelectric device is directed from the front side channel to the rear side channel via a condensation passageway that includes the condensation passageway segment, wherein a portion of the condensation passageway is formed along a bottom plate of the base, the base being tilted relative to horizontal such that condensation generated at the first heat sink is induced by gravity to pool along the bottom plate adjacent the front panel before flowing toward the rear side channel.

16. The system of claim 15, wherein the cooling/heating unit further comprises:

a power supply unit maintained within the housing and electrically connected to the thermoelectric device and the fans, the power supply unit configured to convert AC power to DC power for powering operation of the thermoelectric device.

17. The system of claim 16, wherein the cooling/heating unit further comprises:

a controller maintained within the housing and electrically connected to the power supply unit, the controller adapted to control delivery of power.

18. The system of claim 15, wherein the product container forms a well and the base forms a drainage tube defining the condensation passageway segment, and further wherein upon assembly of the cooling/heating unit to the product container, the drainage tube is fluidly connected to the well and the well is fluidly open to the rear side channel to establish the condensation passageway.

19. The system of claim 15, wherein the interior containment region is defined in part by a compartment liner wall terminating at a leading end adjacent the access opening, and further wherein the housing includes an engagement member sized to receive the leading end upon mounting of the cooling/heating unit to the product container.

20. The system of claim 19, wherein the product container further includes an outer casing exteriorly spaced from the compartment liner wall and forming the access opening, and further wherein mounting of the cooling/heating unit to the product container includes at least a portion of the second heat sink disposed within the outer casing and the rear side channel fluidly isolated from the interior containment region via sealed interface between the compartment liner wall and the engagement member.

21. A method of presenting products to potential consumers, the method comprising:

receiving a cooling/heating unit comprising:

a housing including a front panel and a rear panel assembled to a base, the housing forming:

a front side channel at least partially defined by the front panel, a rear side channel at least partially defined by the rear panel, a condensation passageway segment at least partially defined by the base;

wherein the base includes:

a bottom plate defining a leading side assembled to the front panel and a trailing side assembled to the rear panel; and a rib projecting from the bottom plate intermediate the leading and trailing sides;

wherein the rib partially separates the front and rear side channels in defining a portion of the condensation passageway;

a thermoelectric assembly maintained by the housing and including:

a thermoelectric device forming opposing, first and second surfaces, a first heat sink thermally connected to the first surface and maintained within the front side channel, a second heat sink thermally connected to the second surface and maintained within the rear side channel, a front side fan disposed within the front side channel, a rear side fan disposed within the rear side channel;

forming a first product container defining an interior containment region exteriorly accessible via an access opening and via a door opening apart from the access opening;

removably mounting the cooling/heating unit to the first product container by inserting the front panel into the access opening;

loading product into the interior containment region wherein the loaded product is accessible by a user via the door opening and without moving the cooling/heating unit; and operating the cooling/heating unit to alter a temperature of the loaded product by the front side fan forcing air affected by the first heat sink through the front side channel and into the interior containment region, wherein condensation generated by operation of the thermoelectric device along the front side channel is directed through a condensation passageway including the condensation passageway segment and evaporated to an exterior of the cooling/heating unit via the rear side channel.

22. The method of claim 21, wherein forming a first product container includes:

selecting a product container from a multiplicity of product containers each having differing external dimensions and a rear wall forming the access opening.

23. The method of claim 21, wherein forming a first product container includes:

establishing a size and shape of the access opening as a predetermined standard based upon the size and shape of the front panel; and constructing the product container based upon an expected end use location of the product container and the predetermined size and shape of the opening.

* * * * *